US011273101B2

(12) United States Patent
Weir et al.

(10) Patent No.: US 11,273,101 B2
(45) Date of Patent: Mar. 15, 2022

(54) SYSTEM WITH ADAPTER FOR CLOSED TRANSFER OF FLUIDS

(71) Applicant: Becton Dickinson and Company Limited, Dun Laoghaire (IE)

(72) Inventors: Ross Weir, Cambridge (GB); Lasse Wesseltoft Mogensen, St. Ives (GB)

(73) Assignee: Becton Dickinson and Company Limited, Dun Laoghaire (IE)

( * ) Notice: Subject to any disclaimer, the term of this patent is extended or adjusted under 35 U.S.C. 154(b) by 504 days.

(21) Appl. No.: 16/252,925

(22) Filed: Jan. 21, 2019

(65) Prior Publication Data

US 2019/0151203 A1 May 23, 2019

Related U.S. Application Data

(63) Continuation of application No. 15/034,405, filed as application No. PCT/EP2014/073528 on Nov. 3, 2014, now Pat. No. 10,219,982.

(60) Provisional application No. 61/900,568, filed on Nov. 6, 2013.

(51) Int. Cl.
*A61J 1/20* (2006.01)

(52) U.S. Cl.
CPC ..... *A61J 1/2055* (2015.05); *A61J 1/201* (2015.05); *A61J 1/2096* (2013.01); *A61J 1/2072* (2015.05)

(58) Field of Classification Search
CPC ..... A61J 1/20; A61J 1/2055; A61J 1/2006; A61J 1/2024; A61J 1/2079; A61J 1/202; A61J 1/2048; A61J 1/2068; A61J 1/2089; A61J 1/2031; A61J 1/2034; A61J 1/2065; A61M 5/19; A61M 3/005
See application file for complete search history.

(56) References Cited

U.S. PATENT DOCUMENTS

| | | | | |
|---|---|---|---|---|
| 6,343,629 | B1 | 2/2002 | Wessman et al. | |
| 6,715,520 | B2 | 4/2004 | Andreasson et al. | |
| 6,875,205 | B2 * | 4/2005 | Leinsing | A61J 1/2089 206/828 |
| 8,702,675 | B2 | 4/2014 | Imai | |

(Continued)

FOREIGN PATENT DOCUMENTS

| | | | |
|---|---|---|---|
| EP | 0783872 A2 | 7/1997 | |
| EP | 0783879 A2 * | 7/1997 | A61J 1/2096 |

(Continued)

*Primary Examiner* — Leslie R Deak
*Assistant Examiner* — Gabriella E Burnette
(74) *Attorney, Agent, or Firm* — The Webb Law Firm

(57) ABSTRACT

A system includes a vial access device including a vial access housing having a wall defining an elongate opening between an opening proximal end and an opening distal end, the vial access housing including a spike and a vial connection element attachable to a first vial defining a first vial size to secure the vial access device to the first vial, and an adapter movable within the elongate opening of the vial access housing. The adapter is transitionable between a first position where the adapter is adjacent the opening distal end of the vial access housing and the adapter is attachable to a second vial defining a second vial size and a second position where the adapter is adjacent the opening proximal end of the vial access housing and the vial connection element of the vial access device is attachable to the first vial.

16 Claims, 34 Drawing Sheets

(56) References Cited

U.S. PATENT DOCUMENTS

| | | | |
|---|---|---|---|
| 9,968,520 | B2 | 5/2018 | Tremblay et al. |
| 2016/0206511 | A1 | 7/2016 | Garfield et al. |

FOREIGN PATENT DOCUMENTS

| | | | |
|---|---|---|---|
| JP | 2005516696 | A | 6/2005 |
| WO | 0191693 | A2 | 12/2001 |

* cited by examiner

SYSTEM WITH ADAPTER FOR CLOSED TRANSFER OF FLUIDS

CROSS-REFERENCE TO RELATED APPLICATION

This application is a continuation of U.S. application Ser. No. 15/034,405, filed May 4, 2016, which is a United States National Stage Entry of International Application No. PCT/EP2014/073528, filed Nov. 3, 2014, which claims priority to U.S. Provisional Application Ser. No. 61/900,568, filed Nov. 6, 2013, the entire disclosures of each of which are hereby incorporated by reference in their entirety.

BACKGROUND OF THE INVENTION

1. Field of the Disclosure

The present disclosure relates generally to a system for the closed transfer of fluids. More particularly, the present disclosure relates to a system that accommodates vials having different sizes and provides leak-proof sealing and pressure equalization during engagement of a cannula with a vial, during transfer of a substance from a vial chamber to a barrel chamber via the cannula, and during disengagement of the cannula from the vial.

2. Description of the Related Art

Health care providers reconstituting, transporting, and administering hazardous drugs, such as cancer treatments, can put health care providers at risk of exposure to these medications and present a major hazard in the health care environment. For example, nurses treating cancer patients risk being exposed to chemotherapy drugs and their toxic effects. Unintentional chemotherapy exposure can affect the nervous system, impair the reproductive system, and bring an increased risk of developing blood cancers in the future. In order to reduce the risk of health care providers being exposed to toxic drugs, the closed transfer of these drugs becomes important.

Some drugs must be dissolved or diluted before they are administered, which involves transferring a solvent from one container to a sealed vial containing the drug in powder or liquid form, by means of a needle. Drugs may be inadvertently released into the atmosphere in gas form or by way of aerosolization, during the withdrawal of the needle from the vial and while the needle is inside the vial if any pressure differential between the interior of the vial and the surrounding atmosphere exists.

SUMMARY OF THE INVENTION

In one aspect, a system includes a vial access device including a vial access housing having a wall defining an elongate opening between an opening proximal end and an opening distal end, the vial access housing including a spike and a vial connection element attachable to a first vial defining a first vial size to secure the vial access device to the first vial, and an adapter movable within the elongate opening of the vial access housing. The adapter is transitionable between a first position where the adapter is adjacent the opening distal end of the vial access housing and the adapter is attachable to a second vial defining a second vial size and a second position where the adapter is adjacent the opening proximal end of the vial access housing and the vial connection element of the vial access device is attachable to the first vial.

The vial connection element of the vial access device may include a plurality of vial grip members. The plurality of vial grip members may be elastically deformable. The adapter may include a plurality of adapter vial grip members attachable to the second vial. The second vial size may be less than the first vial size. The adapter may include a locking member engageable with a portion of the vial access housing to prevent the adapter from being removed from within the elongate opening of the vial access housing. The vial access device may include a pressure equalization system. The vial access device may be attachable to the first vial such that the spike is in fluid communication with a chamber of the first vial. The vial access device may be attachable to the second vial via the adapter such that the spike is in fluid communication with a chamber of the second vial. The adapter may include a first end and a second end positioned opposite the first end, with the adapter including a vial connection element positioned adjacent to the second end of the adapter, the first end of the adapter positioned adjacent to the opening distal end of the vial access housing when the adapter is in the first position, and the vial connection element configured to engage the second vial. The adapter may further include locking members engageable with adapter engagement portions of the vial access housing to prevent the adapter from being removed from within the elongate opening of the vial access housing. The adapter engagement portions of the vial access housing may define channels that receive a portion of the locking members of the adapter to provide a guided movement of the adapter between the first position and the second position.

In a further aspect, a method of using the system described above includes engaging a first vial with the vial access device where the adapter is in the first position, transitioning the adapter from first position to the second position, and securing the vial access device to the first vial.

In another aspect, a method of using the system described above includes engaging a second vial with the adapter where the adapter is in the first position, and securing the adapter to the second vial.

In a further aspect, a system includes a first vial defining a first vial size, a second vial defining a second vial size, where the second vial size is different than the first vial size, and a vial access device including a vial access housing having a wall defining an elongate opening between an opening proximal end and an opening distal end. The vial access housing includes a spike and a vial connection element attachable to the first vial to secure the vial access device to the first vial. The system also includes an adapter sized for movement within the elongate opening of the vial access housing. The adapter is transitionable between a first position where the adapter is adjacent the opening distal end of the vial access housing and the adapter is attachable to the second vial, and a second position where the adapter is adjacent the opening proximal end of the vial access housing and the vial connection element of the vial access device is attachable to the first vial.

BRIEF DESCRIPTION OF THE DRAWINGS

The above-mentioned and other features and advantages of this disclosure, and the manner of attaining them, will become more apparent and the disclosure itself will be better understood by reference to the following descriptions of embodiments of the disclosure taken in conjunction with the accompanying drawings, wherein.

Corresponding reference characters indicate corresponding parts throughout the several views. The exemplifications set out herein illustrate exemplary embodiments of the disclosure, and such exemplifications are not to be construed as limiting the scope of the disclosure in any manner.

DETAILED DESCRIPTION

Figure 1:
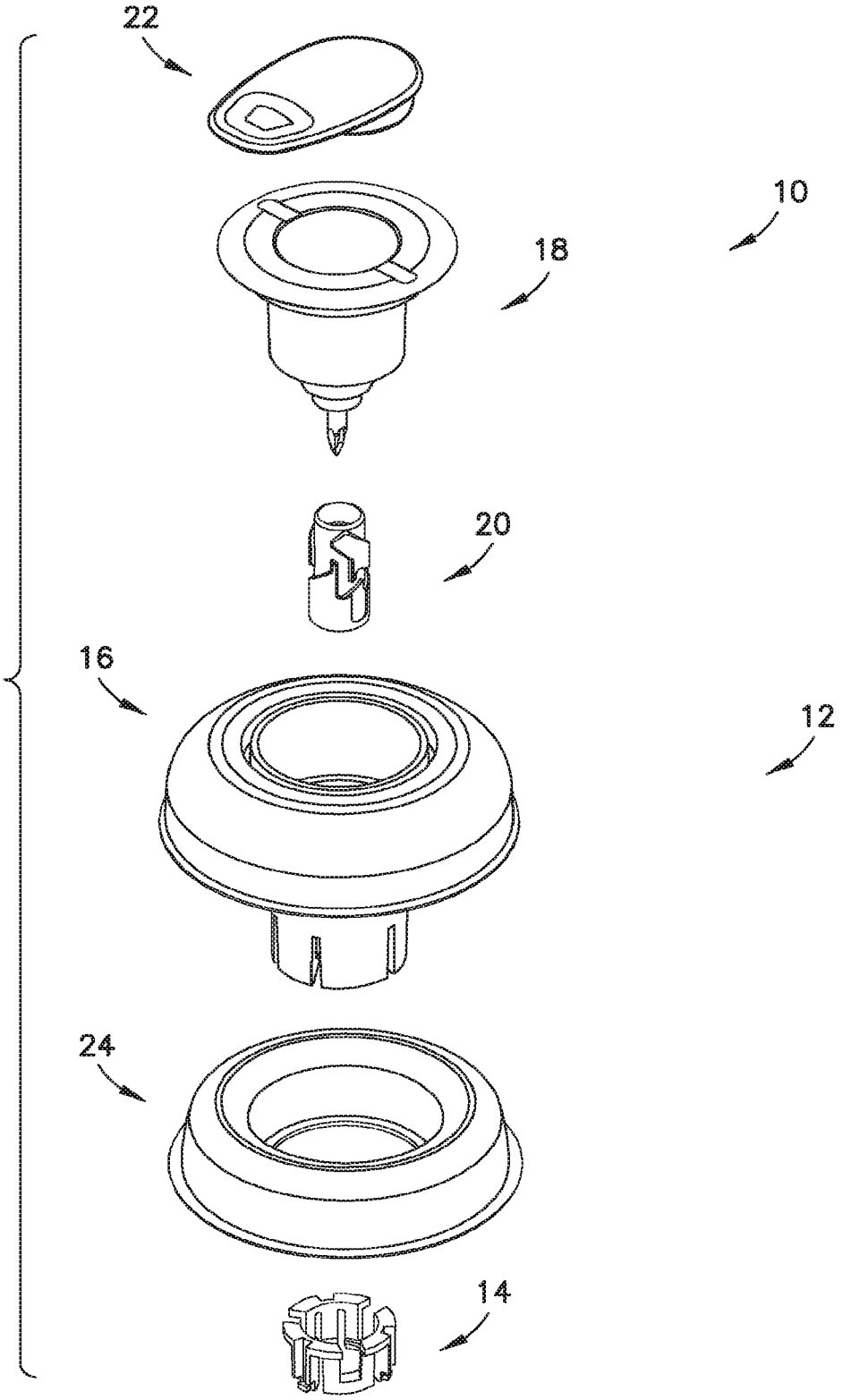
FIG. 1 is an exploded, perspective view of a system in accordance with an embodiment of the present invention.

The following description is provided to enable those skilled in the art to make and use the described embodiments contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

In the following discussion, "distal" refers to a direction generally toward an end of a vial access device adapted for contact with a container, such as a vial, and "proximal" refers to the opposite direction of distal, i.e., away from the end of a vial access device adapted for engagement with the container. For purposes of this disclosure, the above-mentioned references are used in the description of the components of a vial access device in accordance with the present disclosure.

Figure 2:
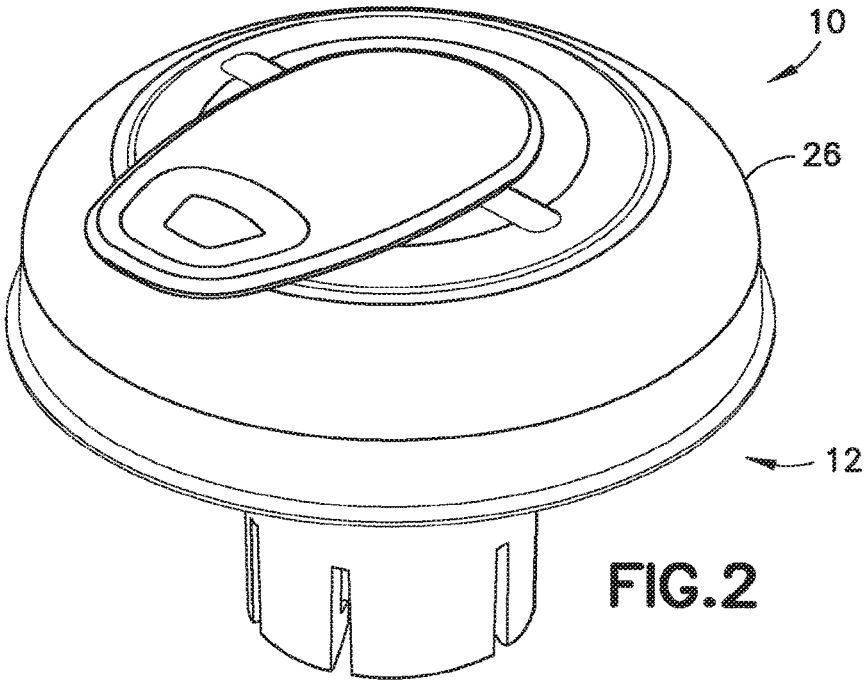
FIG. 2 is an assembled, perspective view of a system in accordance with an embodiment of the present invention.
Figure 3:
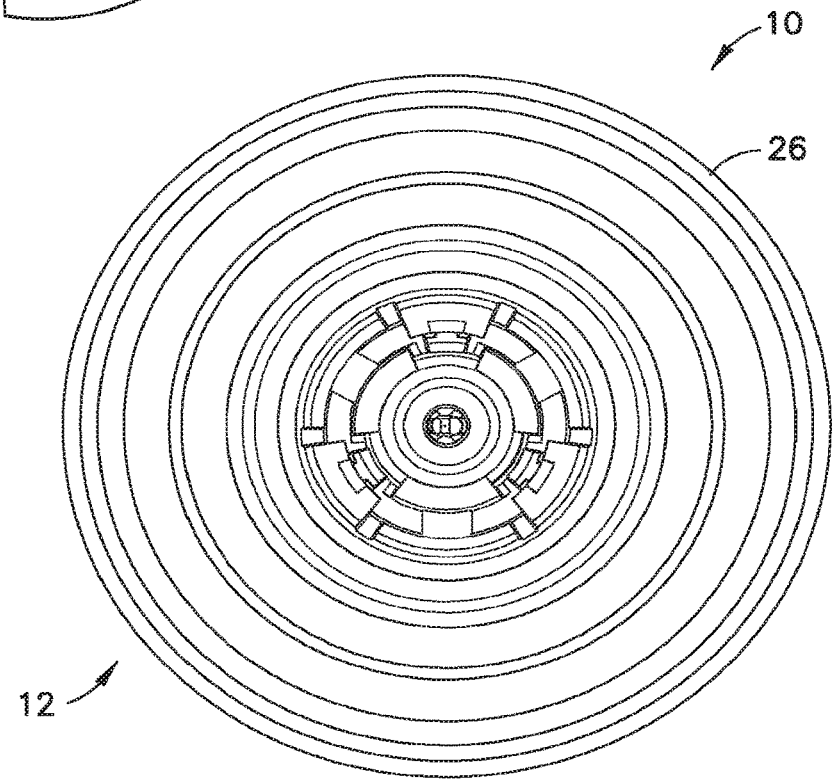
FIG. 3 is a bottom, assembled view of a system in accordance with an embodiment of the present invention.

FIGS. 1-23 illustrate an exemplary embodiment of the present disclosure. Referring to FIGS. 1 and 2, a system 10 for the closed transfer of fluids includes a vial access device 12 and an adapter 14 sized for movement within the vial access device 12 as described in more detail below. In one embodiment, vial access device 12 includes outer housing 16, inner housing 18, connector 20, top cap housing 22, and pressure equalization system 24. System 10 provides a device capable of accommodating a plurality of vials having different sizes. System 10 also provides substantially leak-proof sealing and pressure equalization during engagement of a cannula with a vial, during transfer of a substance from a vial chamber to a barrel chamber via the cannula, and during disengagement of the cannula from the vial. The leak-proof sealing of the system 10 substantially prevents leakage of both air and liquid during use of the system 10. System 10 is compatible with a needle and syringe assembly for accessing a medication contained within a vial for administering the medication to a patient. System 10 is also compatible to be used with a drug reconstitution system.

Figure 13:
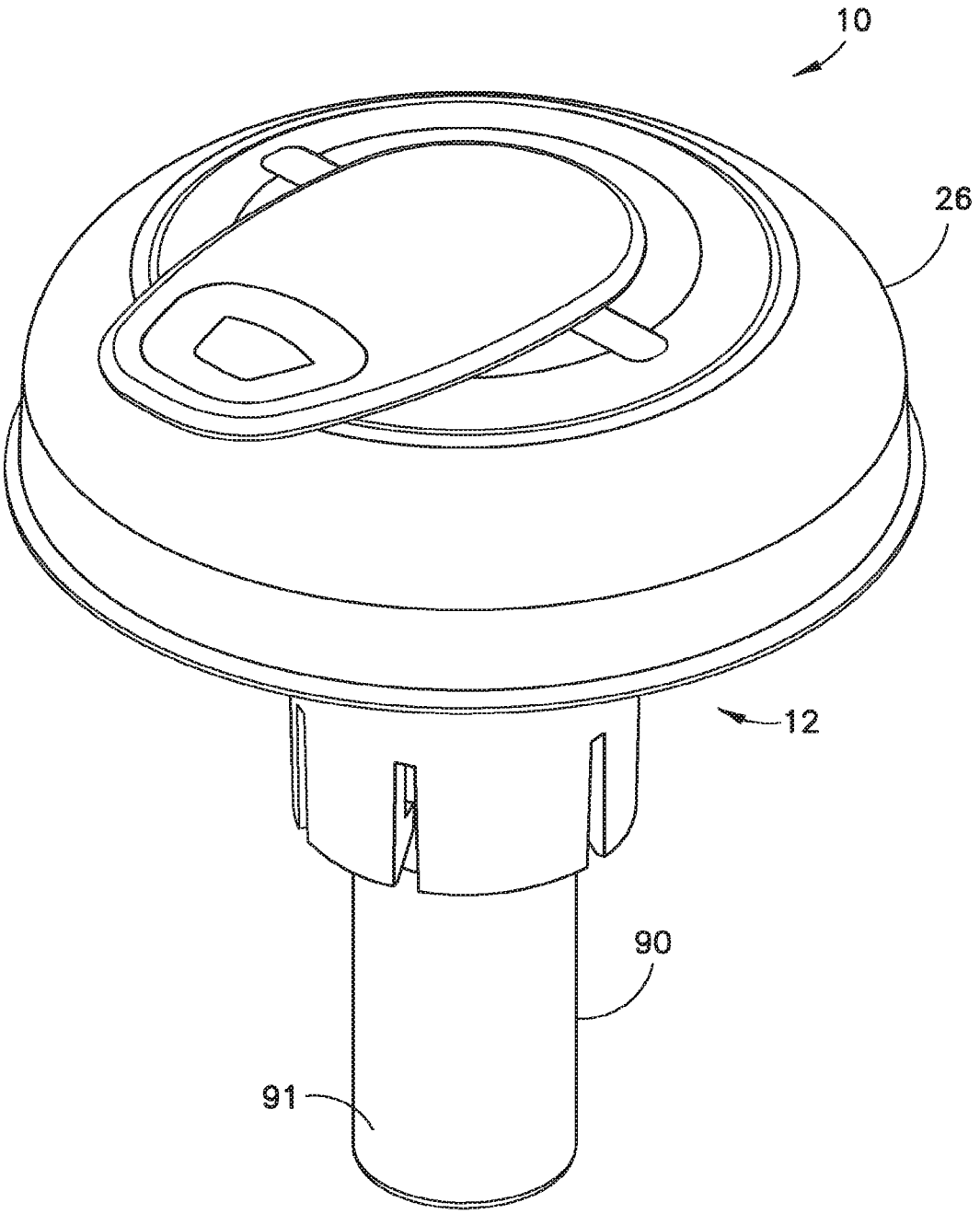
FIG. 13 is a perspective view of a system of the present disclosure connected to a first vial in accordance with an embodiment of the present invention.
Figure 14:
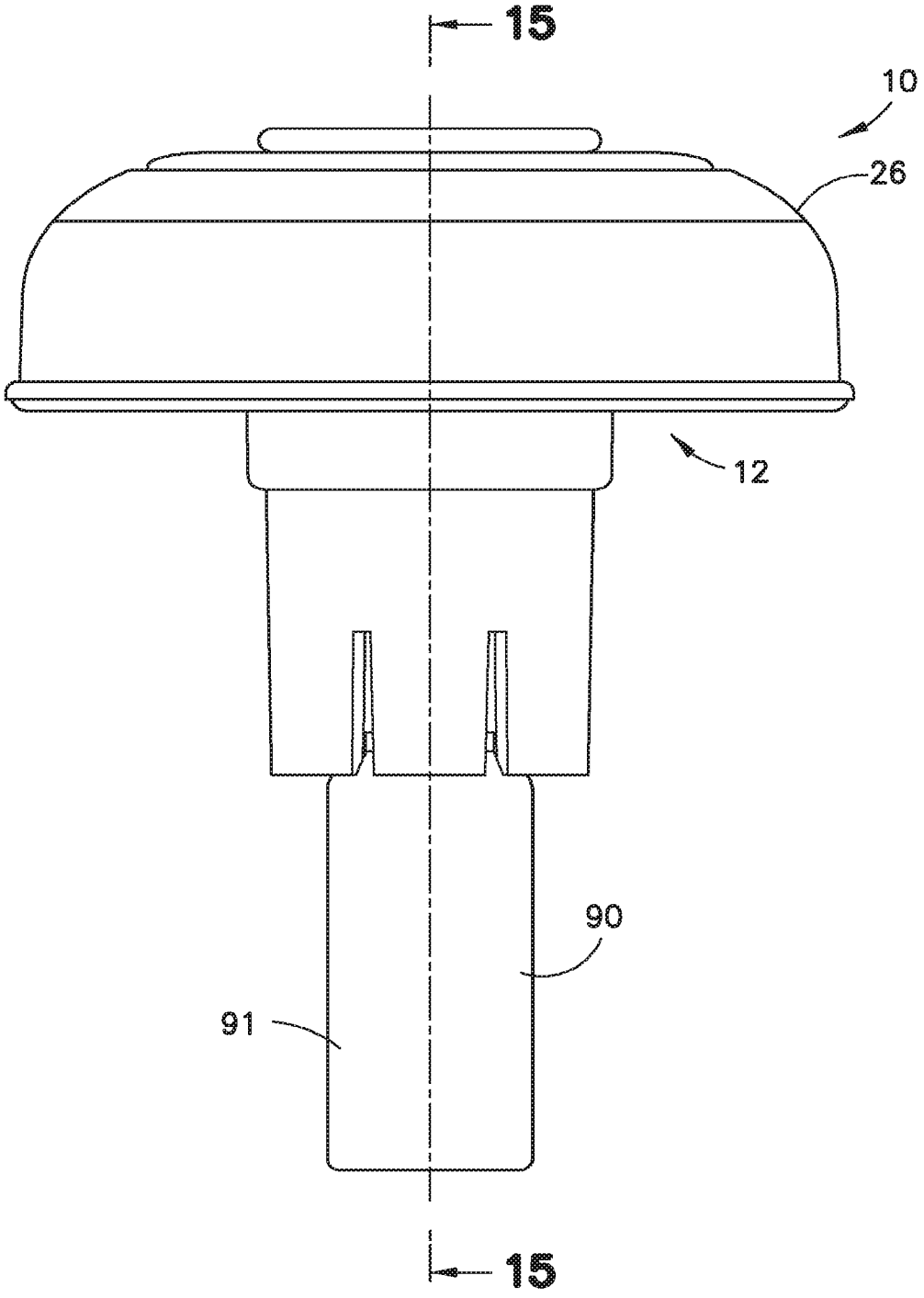
FIG. 14 is a side elevation view of a system of the present disclosure connected to a first vial in accordance with an embodiment of the present invention.
Figure 15:
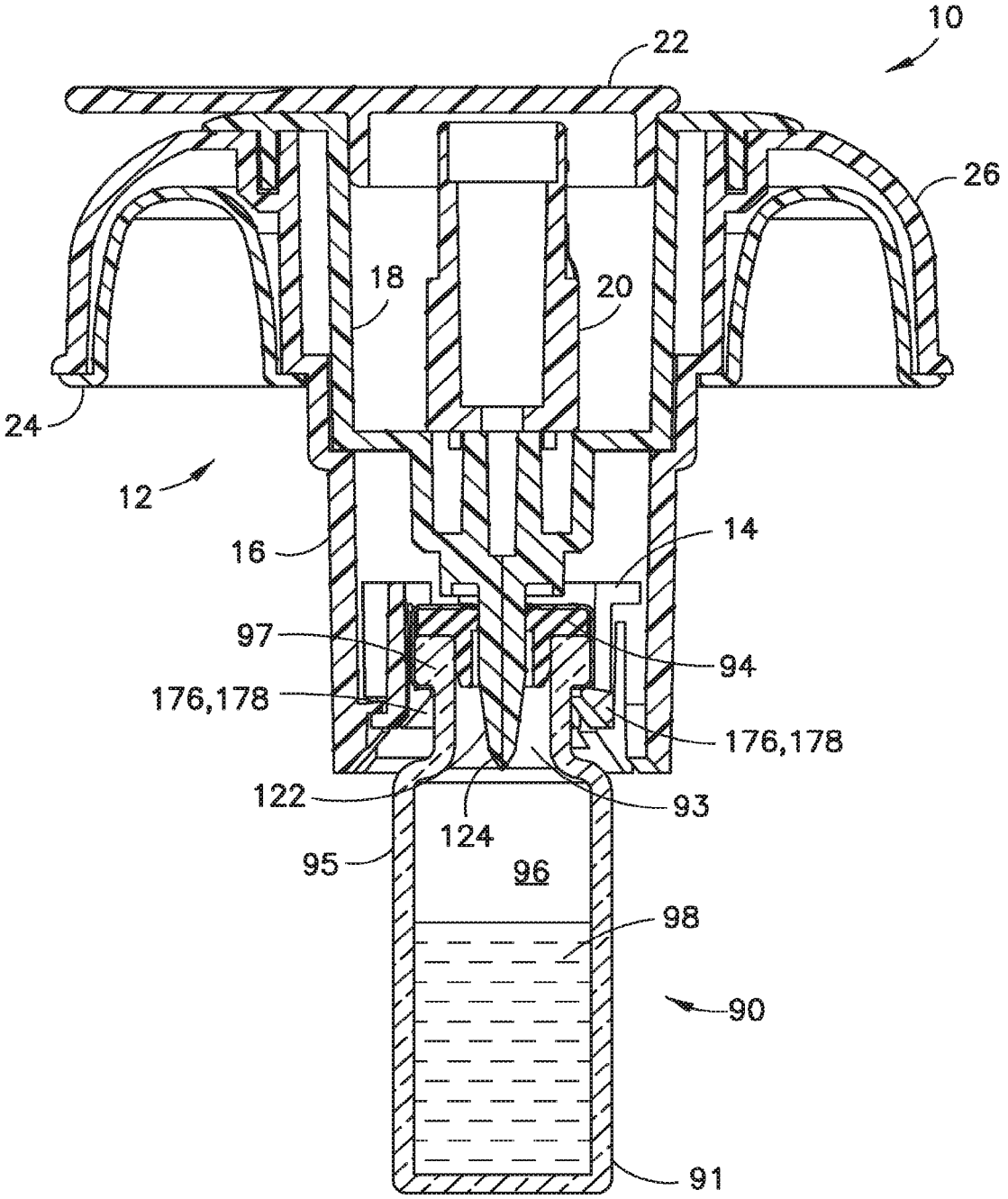
FIG. 15 is a cross-sectional view of the system connected to a first vial taken along line 15-15 of FIG. 14 in accordance with an embodiment of the present invention.

Referring to FIGS. 1-4D, vial access device 12 includes a vial access housing 26 having outer housing 16 and inner housing 18. System 10 provides a device capable of accommodating a plurality of vials having different sizes. Vial access device 12 is configured to establish fluid communication between a first container, e.g., a first vial having a first vial size, and a second container, e.g., a syringe adapter and/or syringe assembly. For example, vial access device 12 is attachable to a first vial 80 as described in more detail below. Referring to FIGS. 16-19, first vial 80 defining a first vial size 81 may be a standard drug vial of any type having an open head portion 83 covered by a pierceable septum 84 of an elastomeric material. Walls 85 of first vial 80 define vial chamber 86 for containing a first substance 88. First vial 80 includes flange 87 located adjacent open head portion 83. Vial septum 84 is engaged with head portion 83 of first vial 80 to seal the first substance 88 within vial chamber 86. Furthermore, adapter 14 of system 10 is configured to establish fluid communication between a first container, e.g., a second vial having a second vial size, and a second container, e.g., a syringe adapter and/or syringe assembly. For example, adapter 14 of system 10 is attachable to a second vial 90 as described in more detail below. Referring to FIGS. 13-15, second vial 90 defining a second vial size 91 may be a standard drug vial of any type having an open head portion 93 covered by a pierceable septum 94 of an elastomeric material. Walls 95 of second vial 90 define vial chamber 96 for containing a second substance 98. Second vial 90 includes flange 97 located adjacent open head portion 93. Vial septum 94 is engaged with head portion 93 of second vial 90 to seal the second substance 98 within vial chamber 96.

Figure 5A:
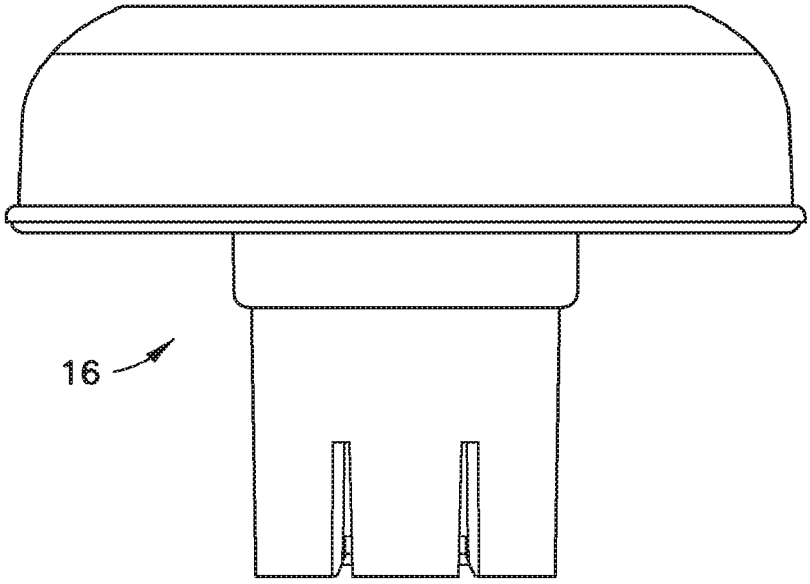
FIG. 5A is a perspective view of an outer housing in accordance with an embodiment of the present invention.
Figure 5B:
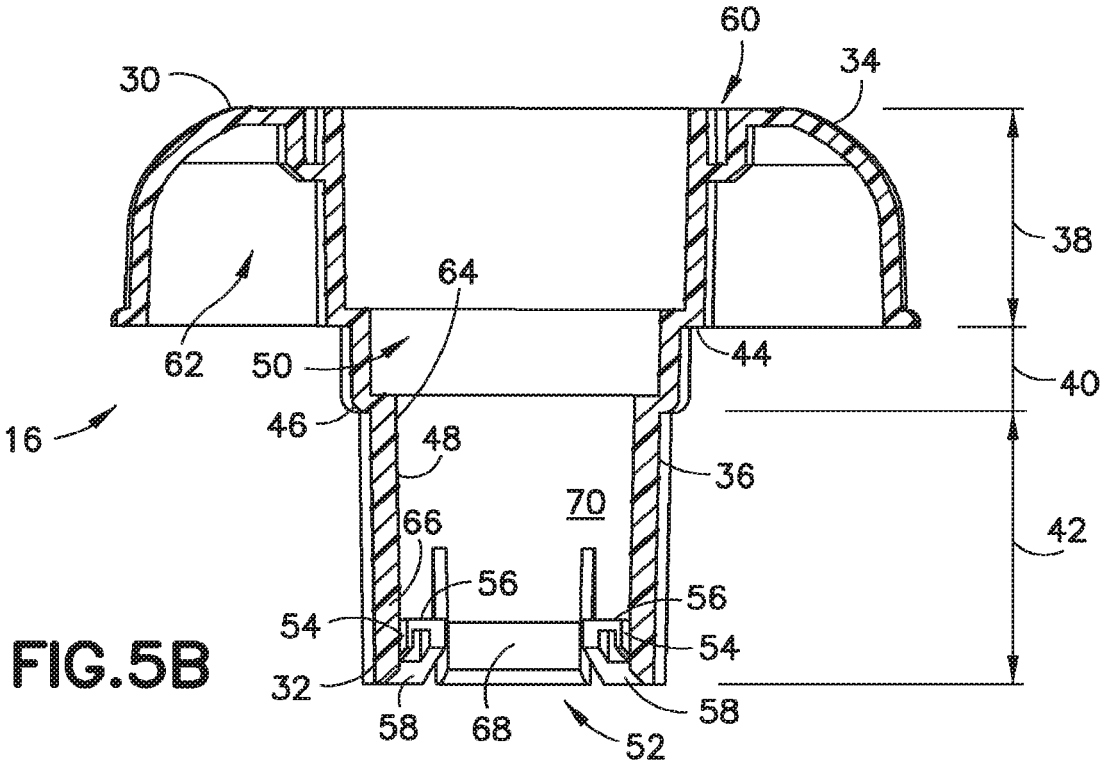
FIG. 5B is a cross-sectional view of the outer housing of FIG. 5A in accordance with an embodiment of the present invention.

Referring to FIGS. 5A and 5B, outer housing 16 generally includes first or proximal end 30; opposing second or distal end 32; outer annular ring portion 34; inner neck portion 36 having first region 38, second region 40, and third region 42; first shoulder 44 disposed between first region 38 and second region 40; second shoulder 46 disposed between second region 40 and third region 42; wall 48 defining elongate opening 50; and vial connection element 52 comprising vial grip members 54, hook protrusions 56, and angled walls 58.

Figure 7:
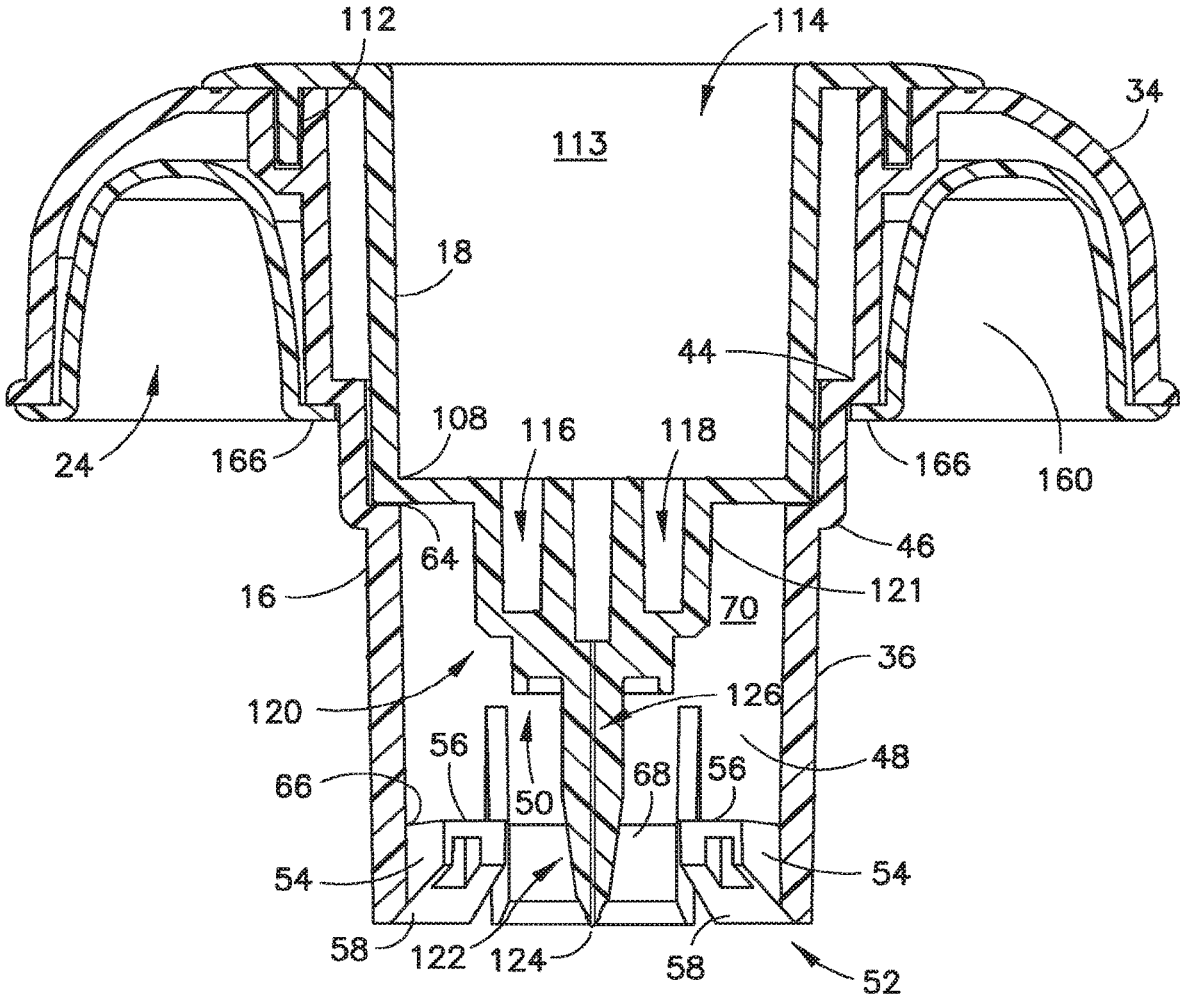
FIG. 7 is a cross-sectional view of a system in accordance with an embodiment of the present invention.

Referring to FIG. 5B, inner neck portion 36 of outer housing 16 includes first region 38, second region 40, and third region 42. Outer annular ring portion 34 extends from first region 38 as shown in FIG. 5B. First shoulder 44 is disposed between first region 38 and second region 40 and is configured to provide an engagement surface with flange portion 166 of pressure equalization housing 160 as shown in FIG. 7. Second shoulder 46 is disposed between second region 40 and third region 42 and is configured to provide an engagement surface with horizontal wall 110 of inner housing 18 as shown in FIG. 7. Vertical wall 48 of third region 42 defines elongate opening 50. Referring to FIG. 7, in one embodiment, vertical wall 48 defines elongate opening 50 between an opening proximal end 64 and an opening distal end 66.

Figure 18:
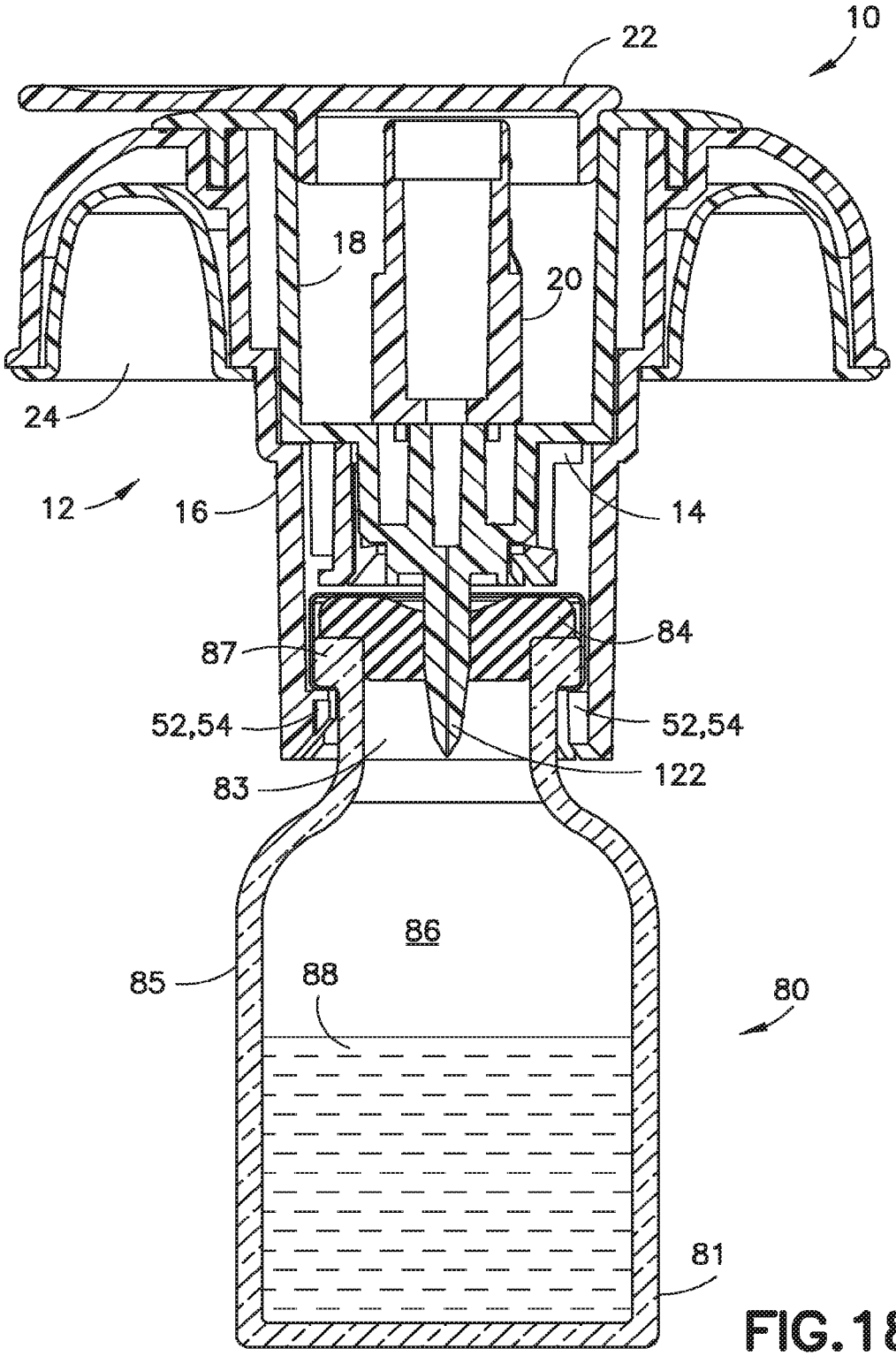
FIG. 18 is a cross-sectional view of the system connected to a second vial taken along line 18-18 of FIG. 17 in accordance with an embodiment of the present invention.

Referring to FIG. 5B, a vial connection element 52 is disposed at second end 32 of outer housing 16. In one embodiment, vial connection element 52 includes a plurality of vial grip members 54 having hook protrusions 56 and angled walls 58. In one embodiment, vial grip members 54 are elastically deformable. Vial grip members 54 are attachable to a first vial 80 to secure vial access device 12 to the first vial 80. Each vial grip member 54 includes a hook protrusion 56 arranged to engage a corresponding flange 87 on a container such as first vial 80 as shown in FIG. 18. Vial connection element 52 of vial access device 12 may be dimensioned to be attached to containers of any size and volume. In other embodiments, vial connection element 52 of vial access device 12 may include other connection mechanisms for securing vial access device 12 to first vial 80 such as a threaded portion, a snap fit mechanism, locking tabs, or other similar mechanism. Each vial grip member 54 includes an angled wall 58 arranged to provide a lead-in surface to center and align vial access device 12 on a vial.

Referring to FIG. 5B, a locking member or adapter engagement portion 68 is disposed on an interior surface 70 of wall 48 at second end 32 of outer housing 16. Adapter engagement portion 68 acts as a physical barrier to prevent adapter 14 from being removed from within elongate opening 50. Adapter 14 is sized for movement within elongate opening 50 of vial access housing 26 and adapter engagement portion 68 prevents adapter 14 from being removed from elongate opening 50. In one embodiment, adapter engagement portion 68 comprises a protrusion.

Referring to FIG. 5B, outer annular ring portion 34 of outer housing 16 includes annular groove 60 for receiving annular protrusion 112 of inner housing 18 as described in more detail below. Outer annular ring portion 34 also includes pressure equalization receiving area 62 for receiving pressure equalization system 24 as described in more detail below.

Referring to FIGS. 6A-6D, inner housing 18 generally includes first or proximal end 100; opposing second or distal end 102; first region 104 and second region 106; first shoulder 108 disposed between first region 104 and second region 106; horizontal wall 110 disposed between first region 104 and second region 106; annular protrusion 112 disposed at first end 100; first region wall 113 defining cavity 114; first groove cavity 116 and second groove cavity 118 within adapter receiving portion 120; second region wall 121; spike member 122 including piercing tip 124; and fluid transfer channel 126.

Figure 6A:
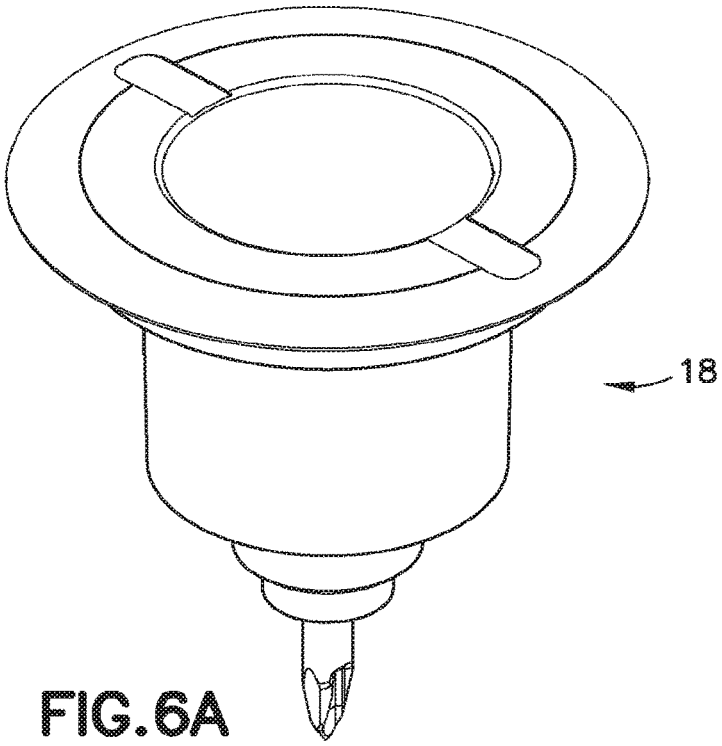
FIG. 6A is a perspective view of an inner housing in accordance with an embodiment of the present invention.
Figure 6B:
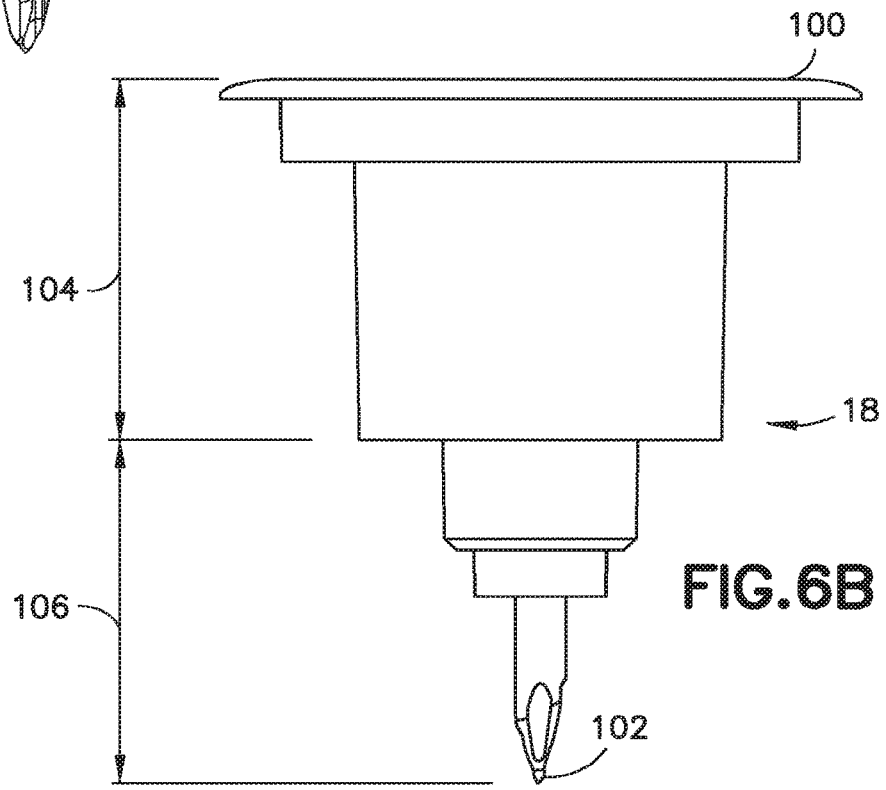
FIG. 6B is a side elevation view of an inner housing in accordance with an embodiment of the present invention.
Figure 6C:
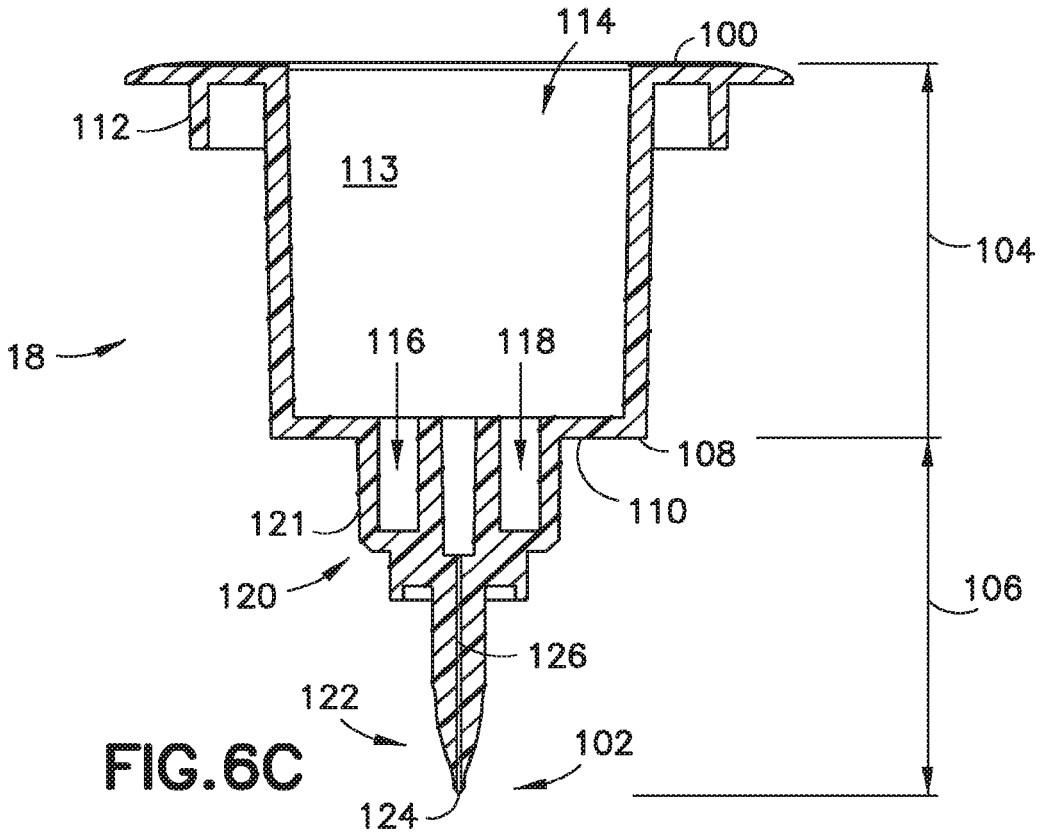
FIG. 6C is a cross-sectional view of the inner housing of FIG. 6A in accordance with an embodiment of the present invention.
Figure 6D:
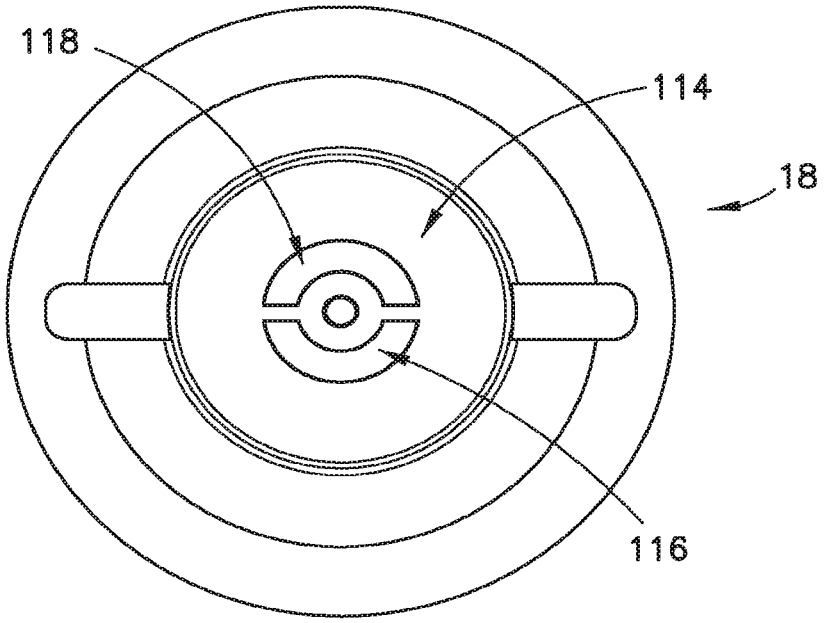
FIG. 6D is a top view of an inner housing in accordance with an embodiment of the present invention.

Referring to FIG. 6C, inner housing 18 includes first region 104 and second region 106. First shoulder 108 is disposed between first region 104 and second region 106 and is configured to engage second shoulder 46 of outer housing 16 as shown in FIG. 7. In this manner, second shoulder 46 of outer housing 16 acts as a physical barrier to prevent inner housing 18 from significant relative movement relative to outer housing 16 as shown in FIG. 7.

Referring to FIG. 6C, annular protrusion 112 extends downward from first end 110 of inner housing 18. Referring to FIG. 7, annular protrusion 112 of inner housing 18 is received within annular groove 60 of annular ring portion 34 of outer housing 16. In this manner, the engagement of annular protrusion 112 of inner housing 18 within annular groove 60 of outer housing 16 secures inner housing 18 to outer housing 16 and prevents inner housing 18 from significant relative movement relative to outer housing 16 as shown in FIG. 7.

Referring to FIG. 6C, horizontal wall 110 is disposed between first region 104 and second region 106. Referring to FIG. 7, horizontal wall 110 together with vertical wall 48 of outer housing 16 defines elongate opening 50 between an opening proximal end 64 and an opening distal end 66.

Referring to FIG. 6C, protruding out from second region wall 121 at second end 102 of inner housing 18 is a piercing member or spike member 122 which includes piercing tip 124. Referring to FIG. 6C, a fluid transfer channel 126 extends through spike member 122 and adapter receiving portion 120 such that piercing tip 124 is in fluid communication with cavity 114 of inner housing 18. The purpose of fluid transfer channel 126 is to permit a needle cannula to extend through vial access device 12 and to thereby permit fluid to be transferred through vial access device 12. In other embodiments, fluid transfer channel 126 may be embodied as any other suitable fluid transfer channel arrangement.

Figure 4A:
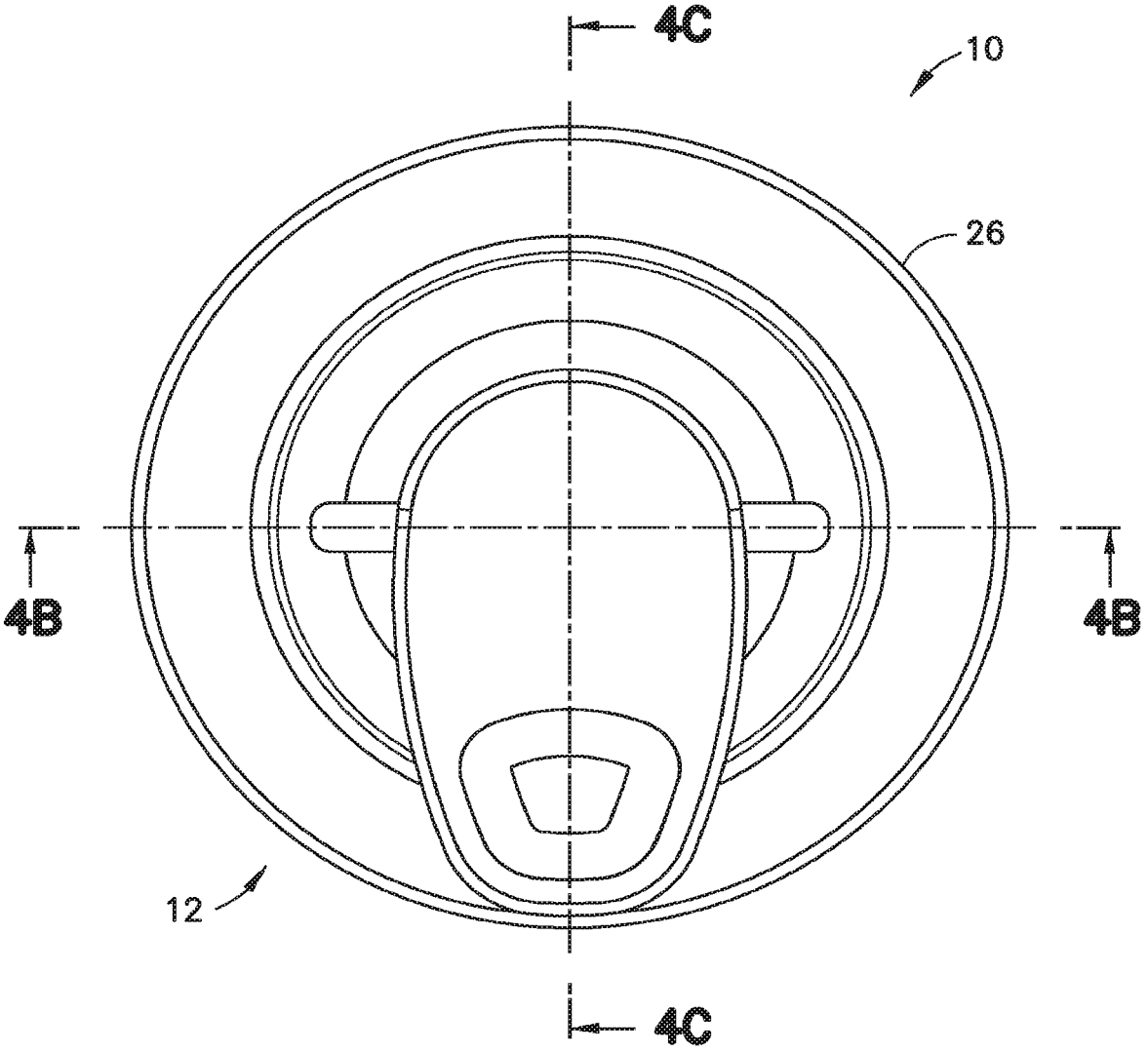
FIG. 4A is a top, assembled view of a system in accordance with an embodiment of the present invention.
Figure 4B:
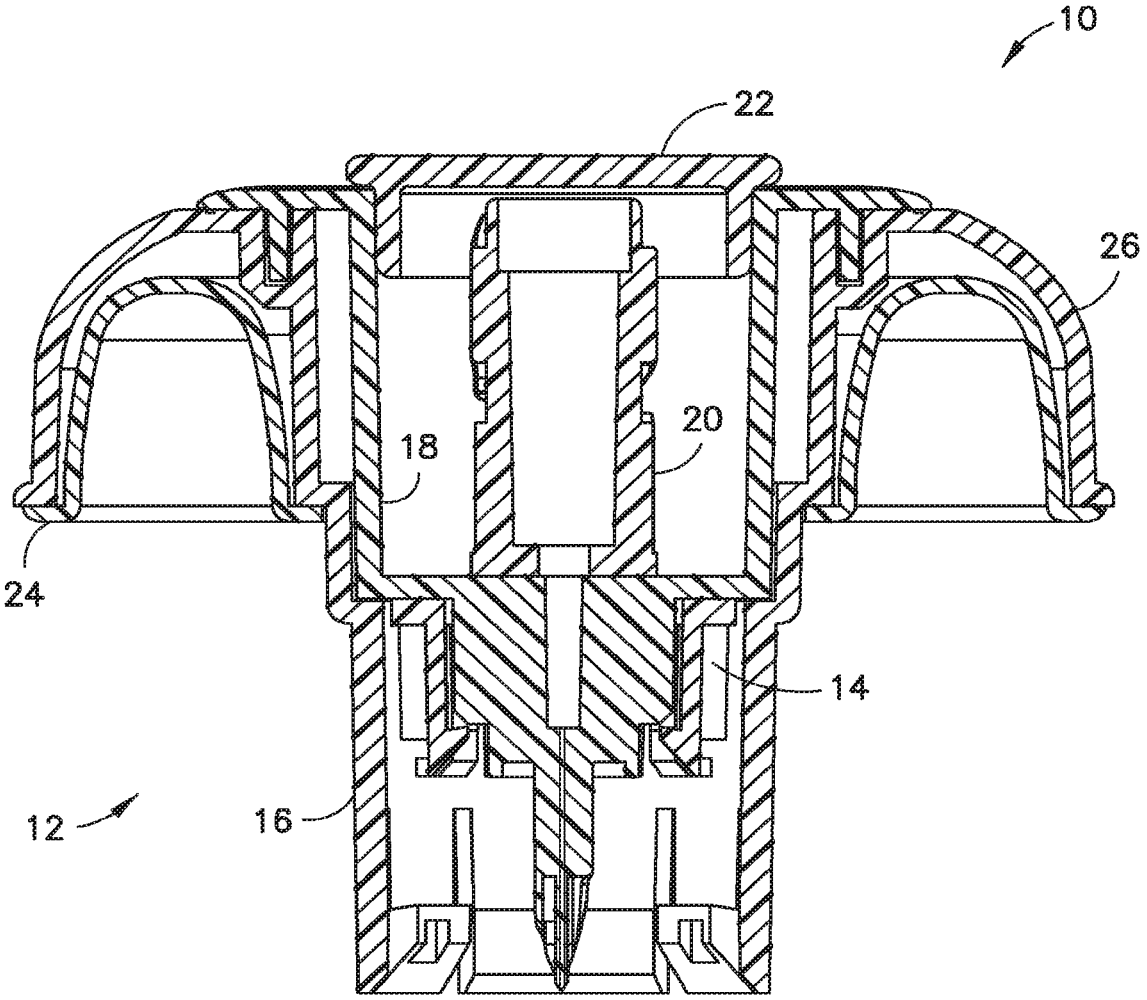
FIG. 4B is a cross-sectional view of the system taken along line 4B-4B of FIG. 4A in accordance with an embodiment of the present invention.
Figure 4C:
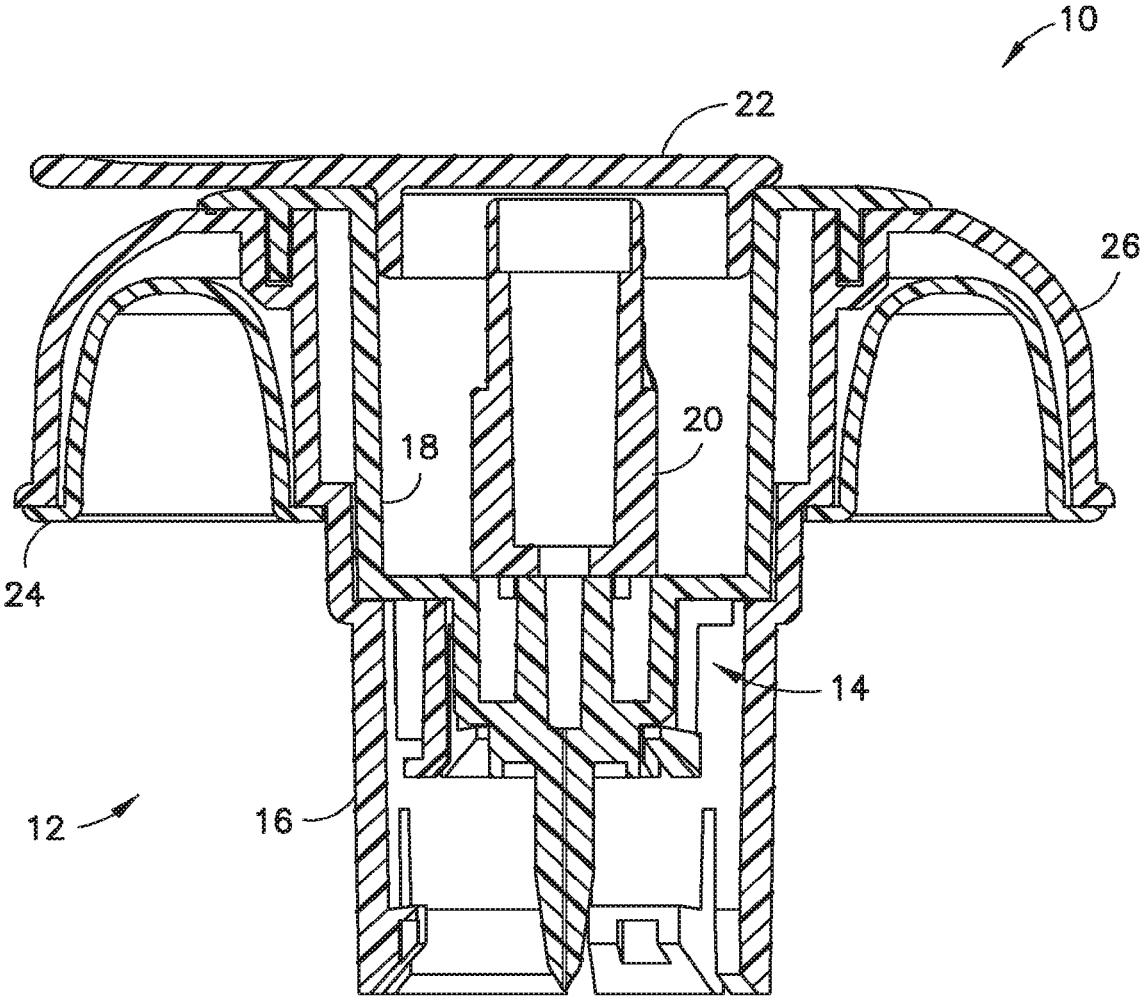
FIG. 4C is a cross-sectional view of the system taken along line 4C-4C of FIG. 4A in accordance with an embodiment of the present invention.
Figure 11:
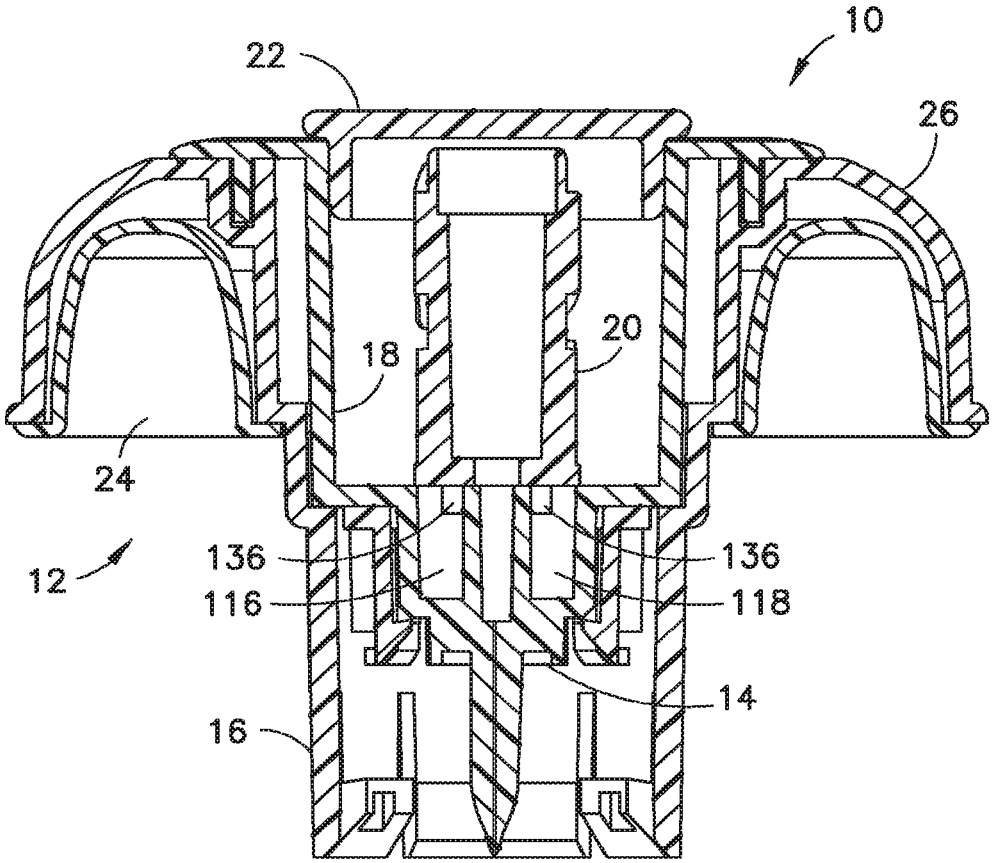
FIG. 11 is a cross-sectional view of a system in accordance with an embodiment of the present invention.

Referring to FIG. 6C, first region wall 113 defines cavity 114. Cavity 114 receives connector 20 and top cap housing 22 as shown in FIG. 4B. In one embodiment, cavity 114 receives top cap housing 22 by an interference fit between the exterior wall surface of sidewall 154 of top cap housing 22 and the interior wall surface of first region wall 113 as shown in FIGS. 4B and 4C. First groove cavity 116 and second groove cavity 118 also receive respective bottom protrusions 136 of connector 20 as shown in FIGS. 4C and 11. In this manner, the engagement of bottom protrusions 136 of connector 20 within respective first groove cavity 116 and second groove cavity 118 secures connector 20 to inner housing 18 and prevents connector 20 from significant relative movement relative to inner housing 18 as shown in FIGS. 4B and 4C.

Referring to FIGS. 4B, 4C, and 7, as described above, inner housing 18 is attachable to outer housing 16 by first shoulder 108 of inner housing 18 engaging second shoulder 46 of outer housing 16 and by annular protrusion 112 of inner housing 18 being received within annular groove 60 of outer housing 16. In this manner, inner housing 18 is secured to outer housing 16 and inner housing 18 is prevented from significant relative movement relative to outer housing 16.

In one embodiment, outer housing 16 and inner housing 18 may form a single integral component. In another embodiment, outer housing 16 and inner housing 18 are separate components and inner housing 18 is attachable to outer housing 16 such that significant relative movement between outer housing 16 and inner housing 18 is prevented.

Referring to FIG. 7, with inner housing 18 secured to outer housing 16, spike member 122 extends in a direction substantially parallel with the plurality of vial grip members 54. Spike member 122 serves the purpose of piercing a fluid container such as first vial 80 during assembly of vial access device 12 to first vial 80 as shown in FIG. 18 and also serves the purpose of piercing a fluid container such as second vial 90 during assembly of vial access device 12 to second vial 90 as shown in FIG. 15.

Referring to FIGS. 8A-8G, in one embodiment, connector 20 generally includes first or proximal end 130; opposing second or distal end 132; a membrane cavity 134 located at first end 130; a bottom protrusion 136 located at second end 132; and a locking groove 138. In other embodiments, connector 20 comprises other connectors which are compatible with a closed system drug transfer device.

Referring to FIGS. 4B and 4C, as described above, connector 20 is attachable to inner housing 18 by cavity 114 of inner housing 18 receiving connector 20 and first groove cavity 116 and second groove cavity 118 also receiving respective bottom protrusions 136 of connector 20. In this manner, the engagement of bottom protrusions 136 of connector 20 within respective first groove cavity 116 and second groove cavity 118 secures connector 20 to inner housing 18 and prevents connector 20 from significant relative movement relative to inner housing 18 as shown in FIGS. 4B and 4C.

Figure 8A:
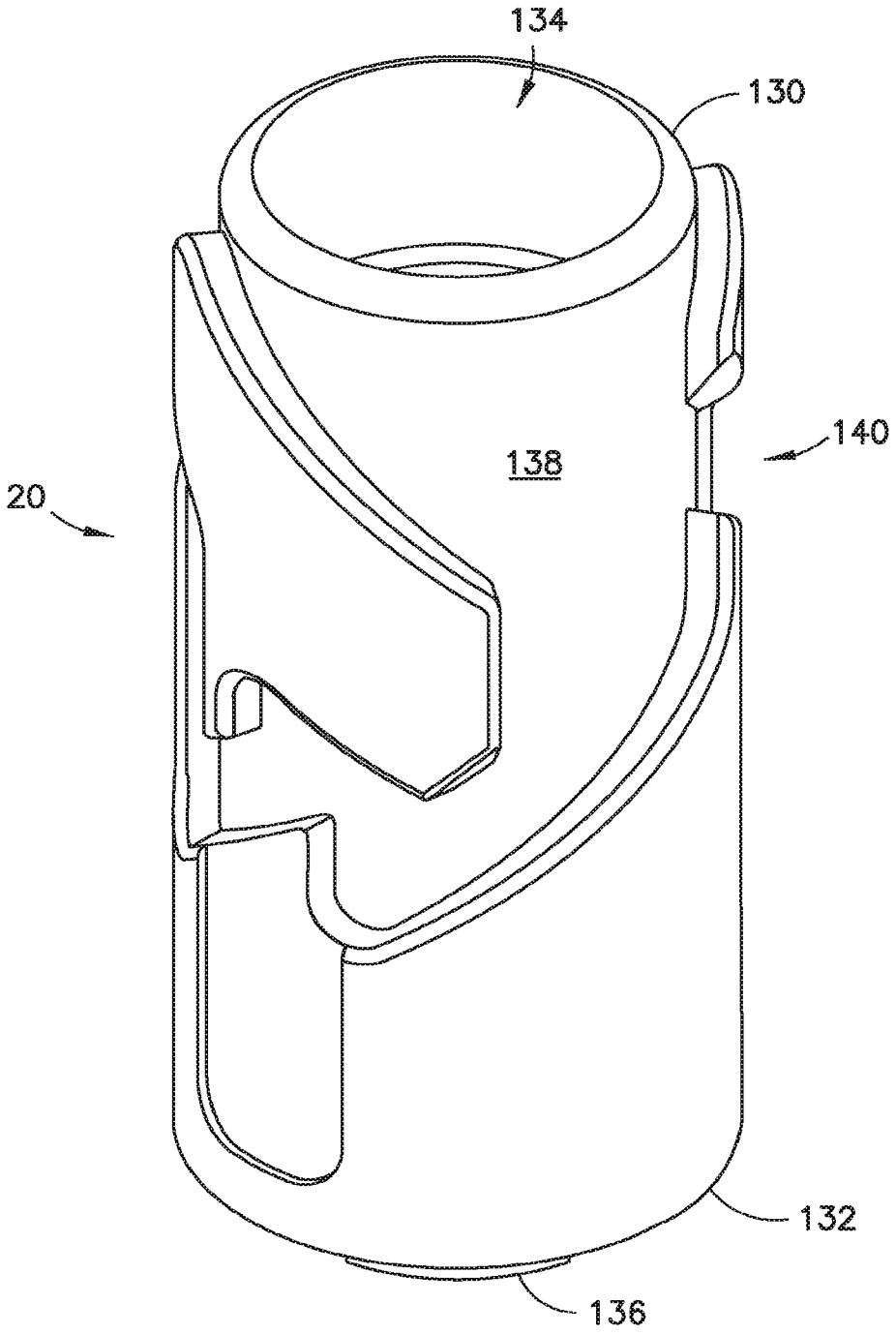
FIG. 8A is a perspective view of a connector in accordance with an embodiment of the present invention.
Figure 8B:
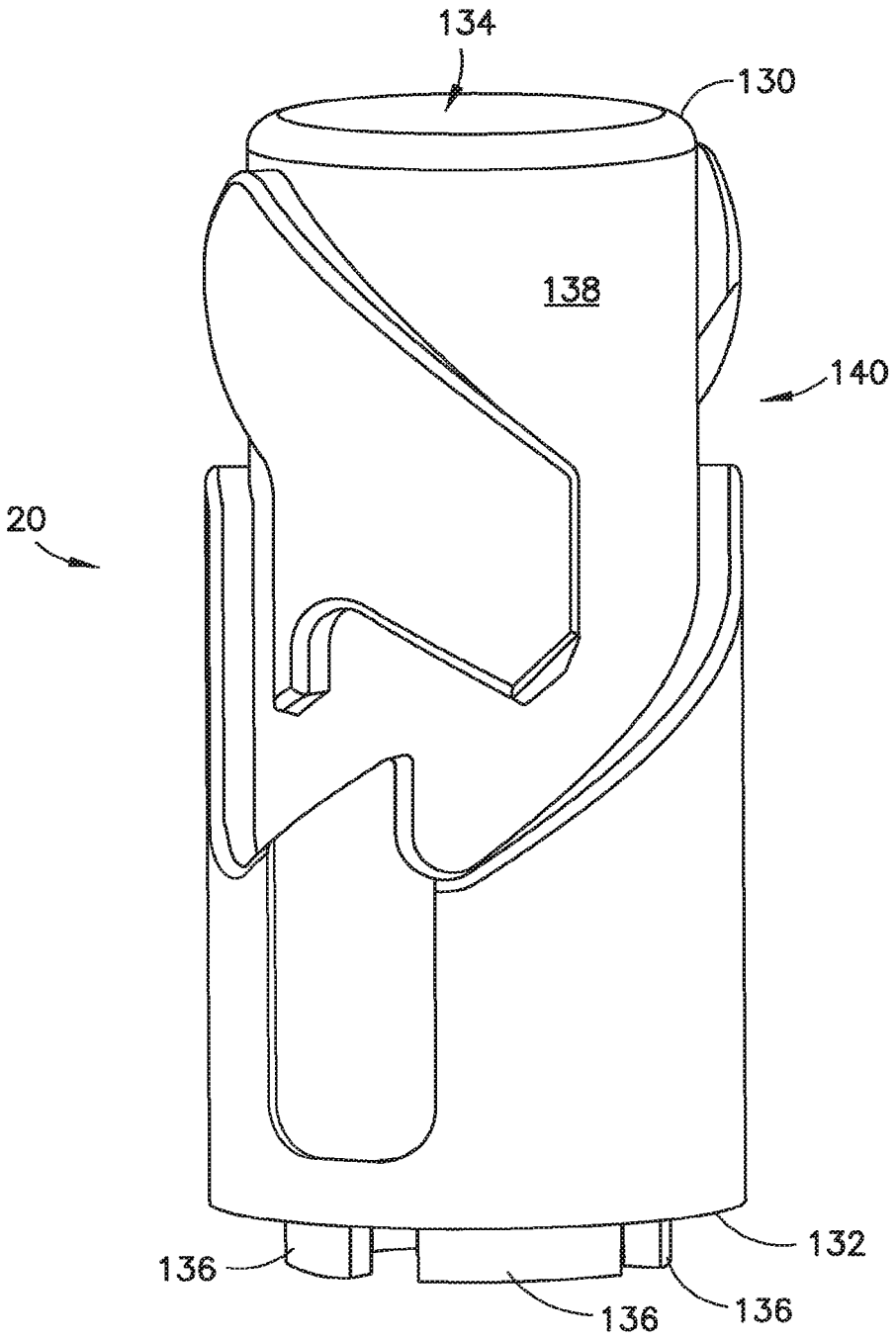
FIG. 8B is a side elevation view of a connector in accordance with an embodiment of the present invention.
Figure 8C:
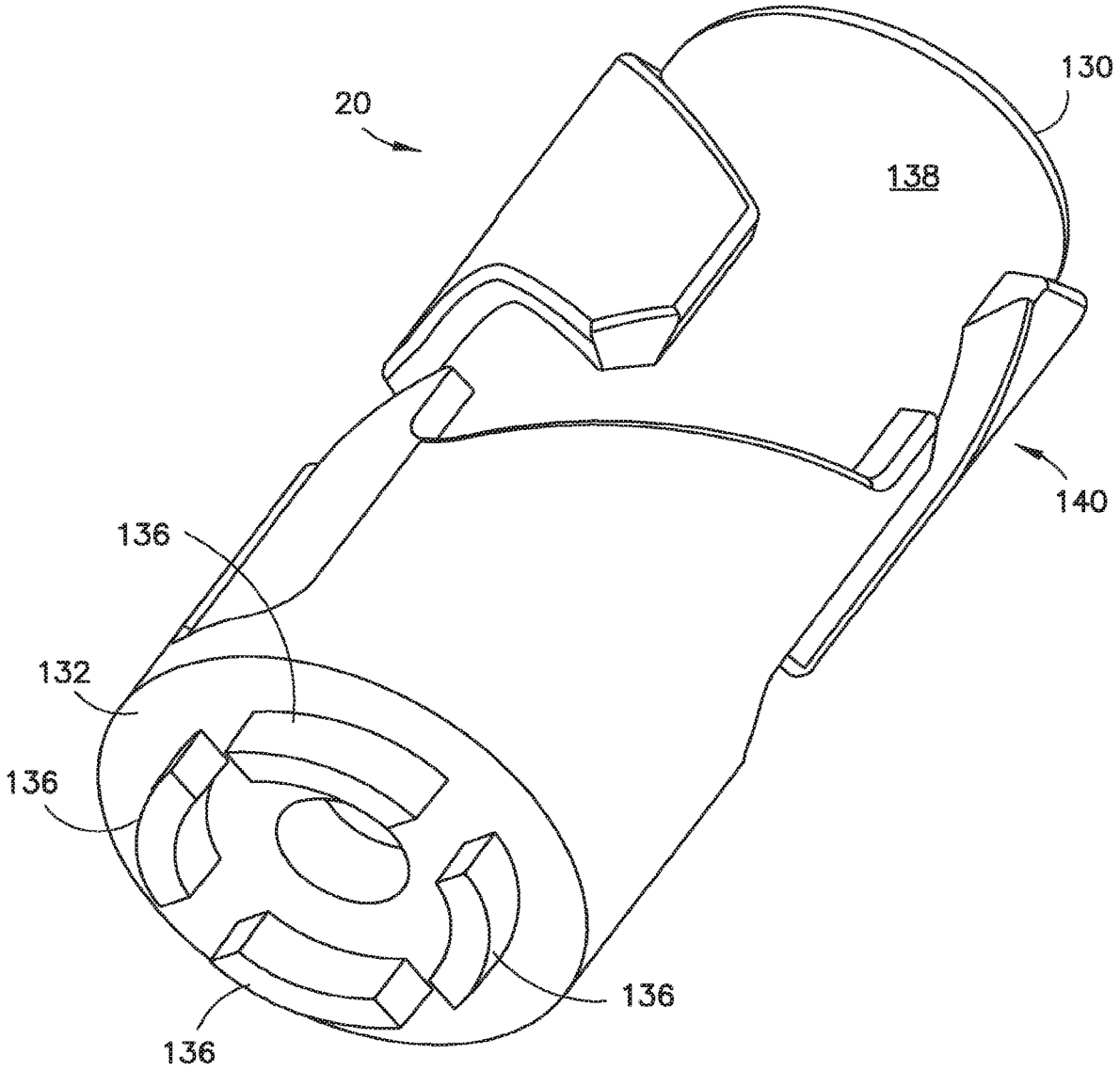
FIG. 8C is another perspective view of a connector in accordance with an embodiment of the present invention.
Figure 8D:
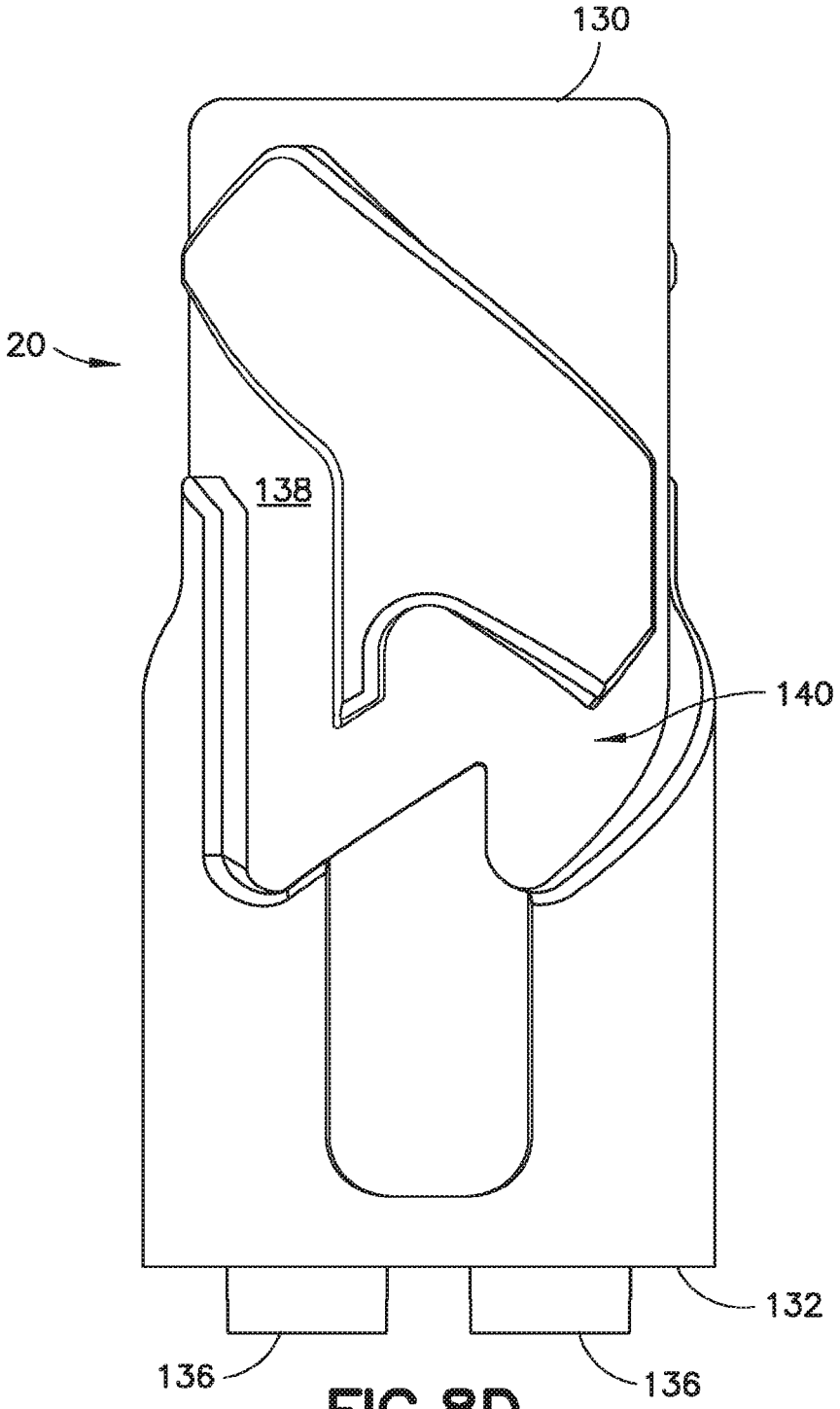
FIG. 8D is another side elevation view of a connector in accordance with an embodiment of the present invention.
Figure 8E:
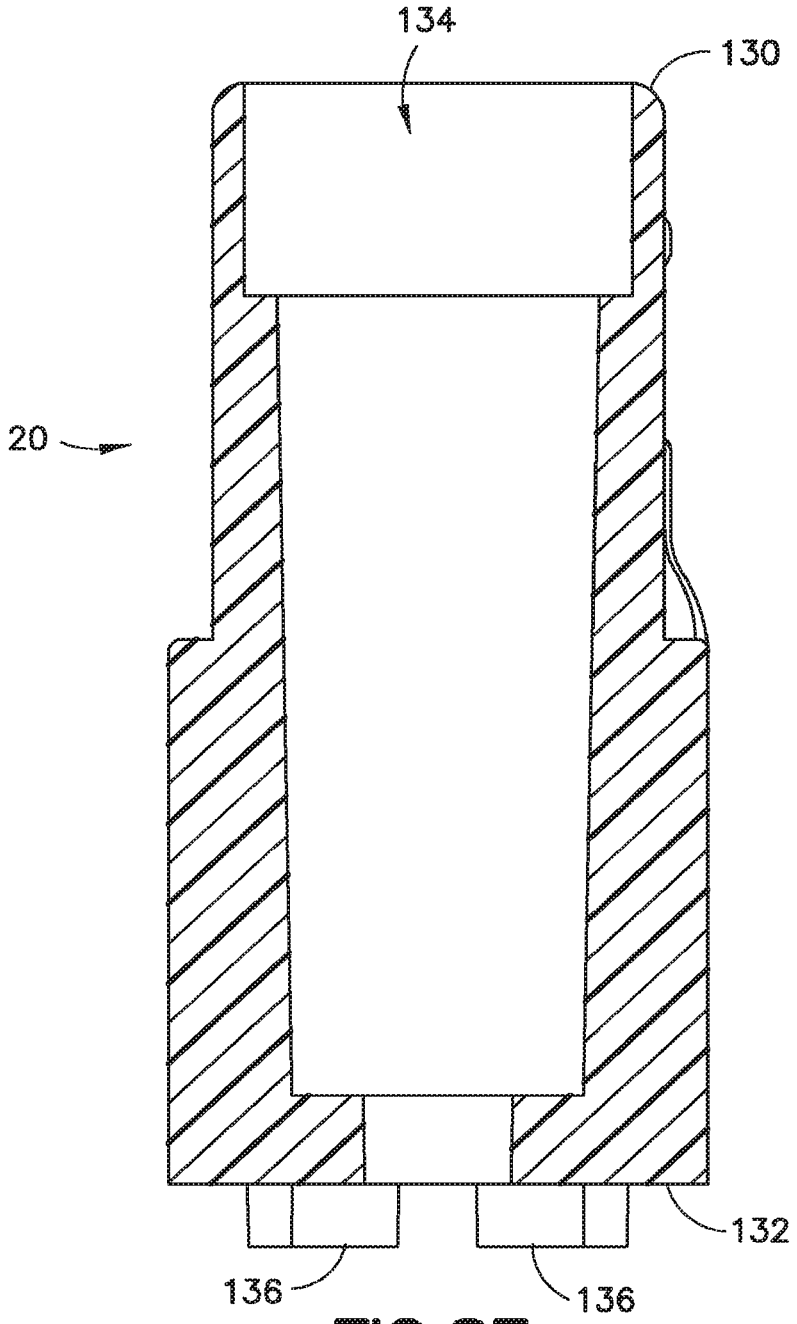
FIG. 8E is a cross-sectional view of the connector of FIG. 8A in accordance with an embodiment of the present invention.
Figure 8F:
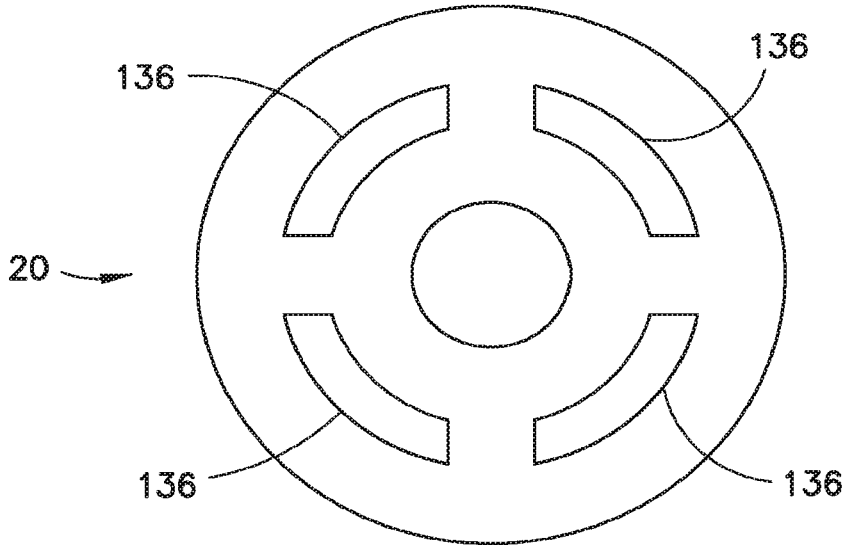
FIG. 8F is a bottom view of a connector in accordance with an embodiment of the present invention.
Figure 8G:
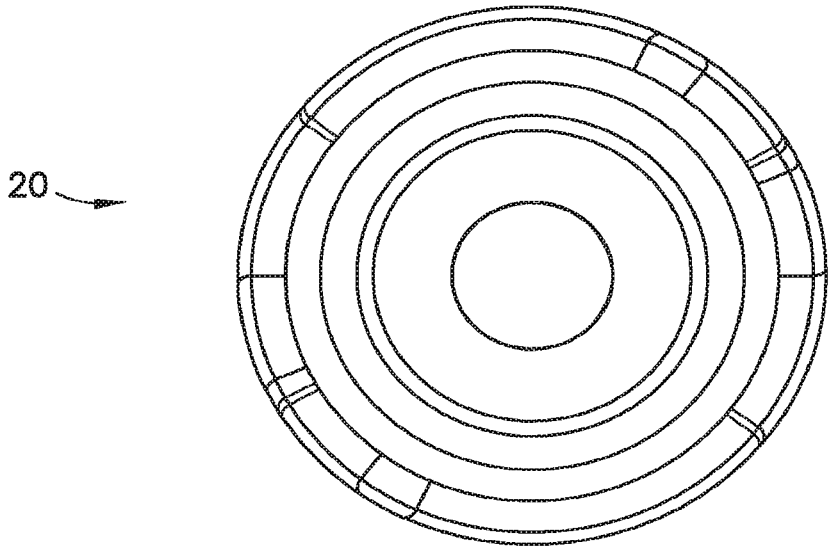
FIG. 8G is a top view of a connector in accordance with an embodiment of the present invention.

Referring to FIG. 8A, connector 20 includes a connection element or connection system 140. In one embodiment, connection system 140 comprises locking groove 138. Locking groove 138 of connector 20 is engageable with a portion of a syringe adapter, e.g., syringe adapter 27 (FIGS. 20 and 21), to secure the syringe adapter to connector 20 and vial access device 12. Connection system 140 of connector 20 provides a secured attachment between vial access device 12 and an syringe adapter such that significant relative movement between the syringe adapter and vial access device 12 is prevented and such that a cannula of the syringe adapter is maintained in a leak-proof sealing system throughout the process of engaging the cannula with a vial. The connector 20 may be embodied as any other suitable connection arrangement.

Referring to FIGS. 4B and 4C, in one embodiment, membrane cavity 134 of connector 20 may contain a pierceable barrier member. In other embodiments, other suitable barrier members may be utilized. The pierceable barrier member provides for a liquid and gas tight seal between a piercing member and the pierceable barrier member during fluid transfer to minimize leakage and thereby prevent exposure of hazardous medicaments to a user. The pierceable barrier member provides a self-sealing seal that, with vial access device 12 attached to a vial, provides a leak-proof seal preventing any substance contained within the vial chamber 96 from being exposed to a health care provider reconstituting, transporting, or administering a drug using system 10. In one embodiment, the pierceable barrier member comprises a resilient material. For example, the pierceable barrier member is preferably a unitary device molded of any flexible, elastomeric material conventionally used for fabricating gas-proof closures. The pierceable barrier member may be formed of a natural rubber material, polyurethane elastomers, butyl rubbers, or similar materials. It is contemplated that the pierceable barrier member is formed of a material having a Shore A hardness of approximately 10 to 50. It is also envisioned that the pierceable barrier member can have other material hardness values that would provide an appropriate self-sealing material to provide a leak-proof seal with a vial septum of a vial and an syringe adapter, thereby preventing any liquid or medication residue from being exposed to a health care provider reconstituting, transporting, or administering a drug using system 10.

Figure 9A:
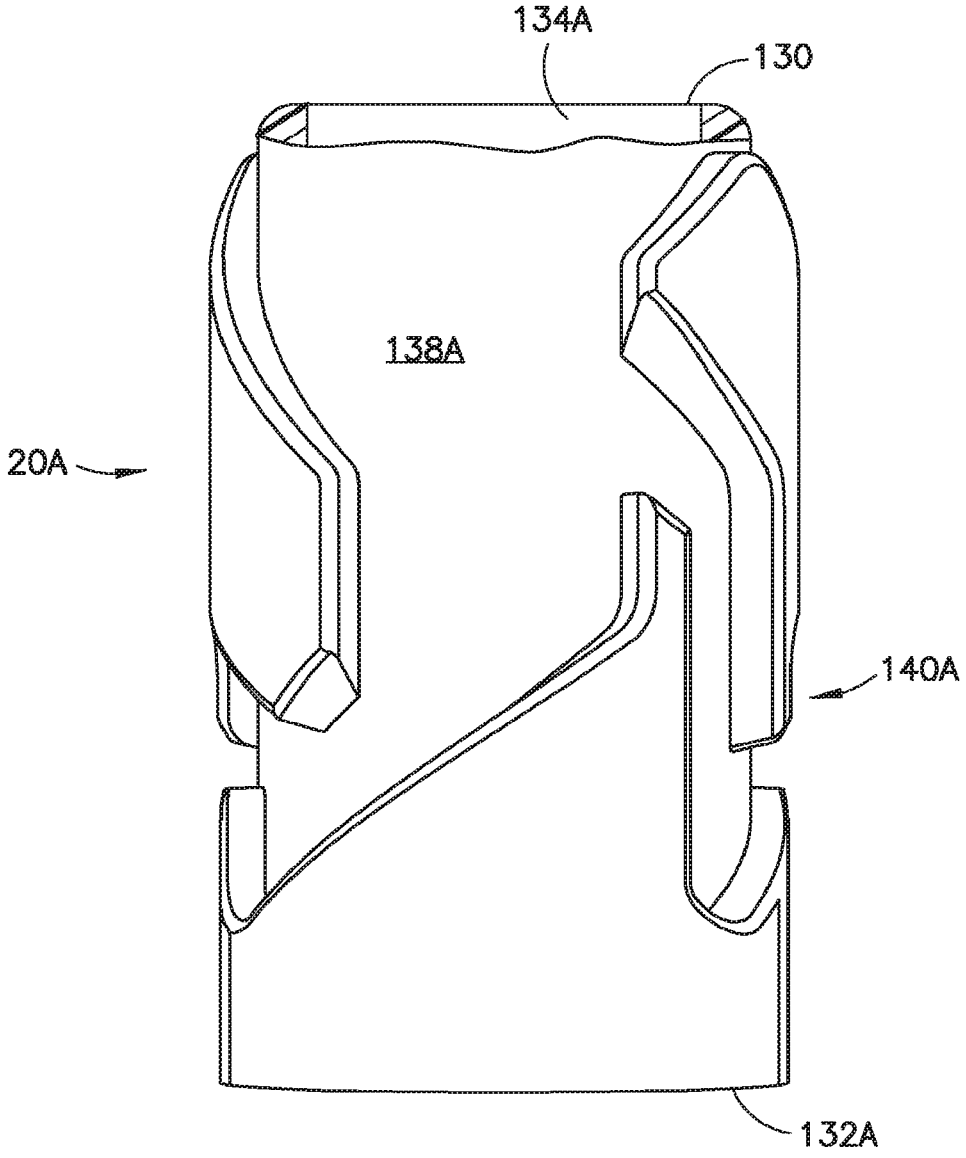
FIG. 9A is a side elevation view of a connector in accordance with another embodiment of the present invention.
Figure 9B:
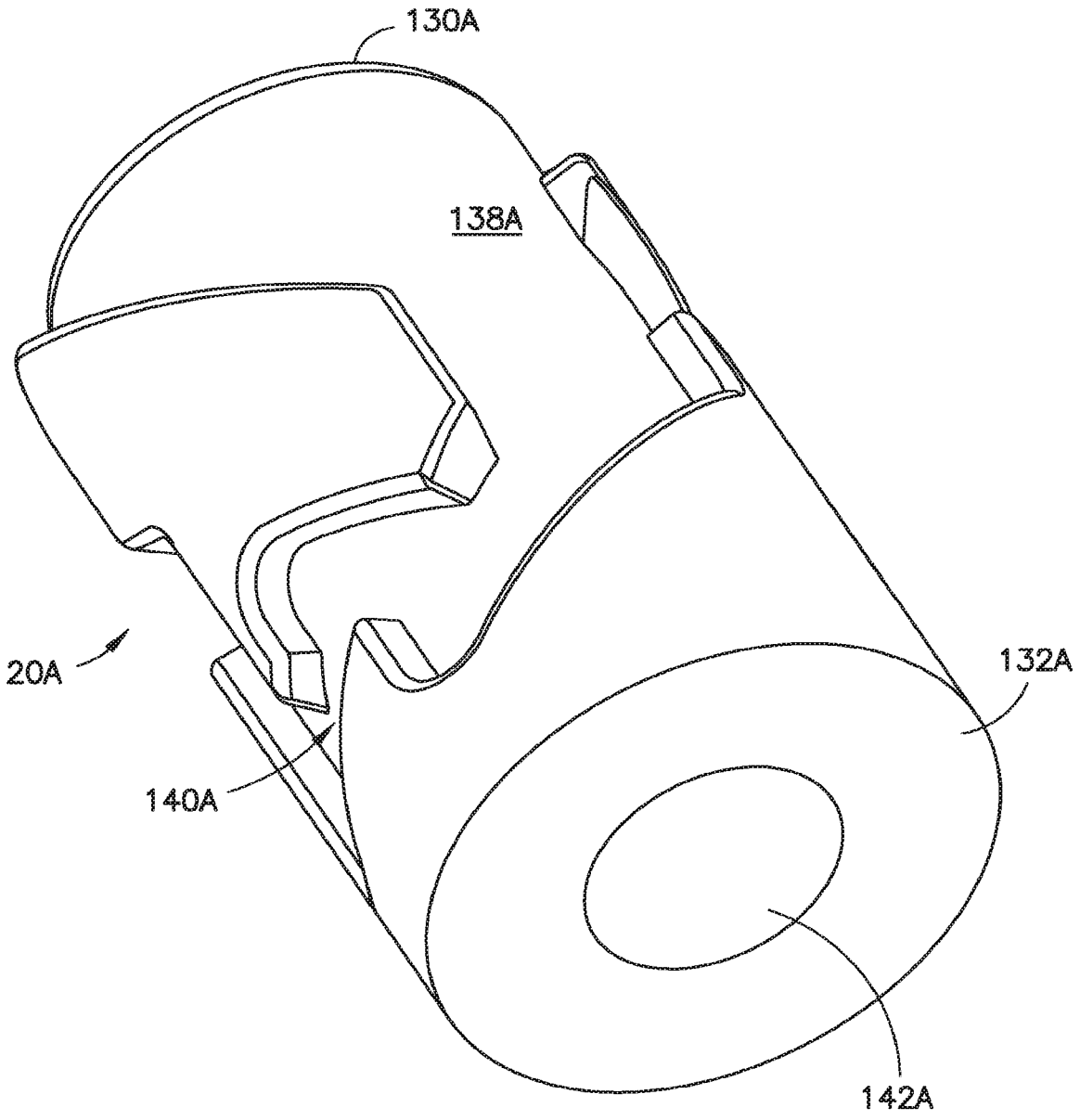
FIG. 9B is a perspective view of a connector in accordance with another embodiment of the present invention.

FIGS. 9A and 9B illustrate another exemplary embodiment of a connector of the present disclosure. The embodiment illustrated in FIGS. 9A and 9B includes similar components to the embodiment illustrated in FIGS. 8A-8G, and the similar components are denoted by a reference number followed by the letter A. For the sake of brevity, these similar components and the similar steps of using connector 20A (FIGS. 9A and 9B) will not all be discussed in conjunction with the embodiment illustrated in FIGS. 9A and 9B.

Referring to FIGS. 9A and 9B, in one embodiment, connector 20A includes bottom aperture 142A. Connector 20A is attachable to inner housing 18 by cavity 114 of inner housing 18 receiving connector 20A and bottom aperture 142A of connector 20A being locked over a protrusion on inner housing 18 to secure connector 20A to inner housing 18 and prevent connector 20A from significant relative movement relative to inner housing 18.

Figure 10:
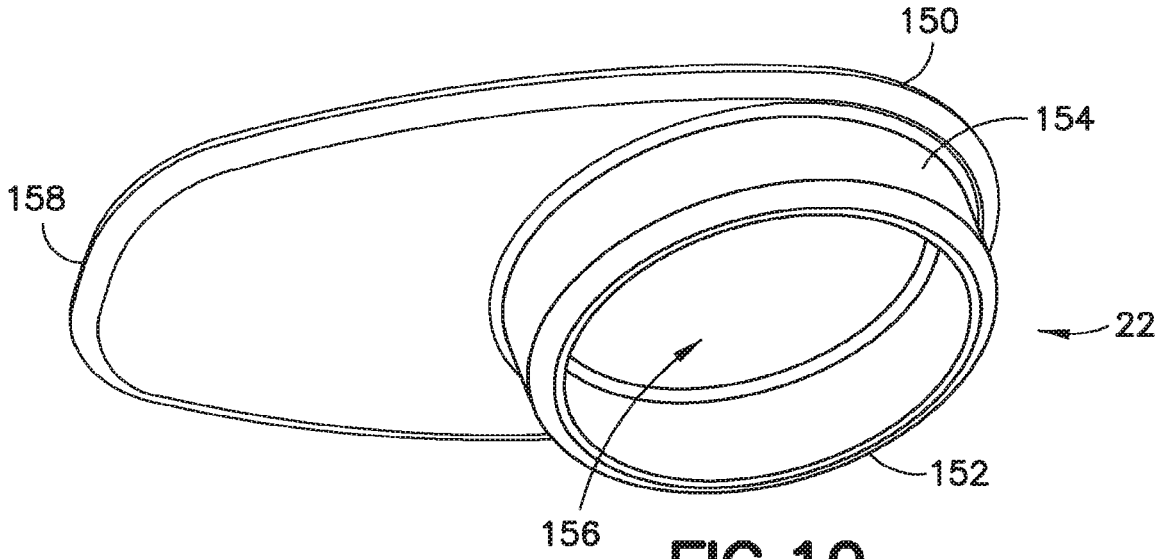
FIG. 10 is a perspective view of a top cap housing in accordance with an embodiment of the present invention.

Referring to FIG. 10, in one embodiment, top cap housing 22 generally includes first or proximal end 150; opposing second or distal end 152; a sidewall 154 extending between first end 150 and second end 152 and defining a connector receiving portion 156; and a handle portion 158. In other embodiments, top cap housing 22 comprises other covers which are compatible with a closed system drug transfer device. For example, top cap housing 22 may be embodied as any other suitable cover arrangement.

Referring to FIGS. 4B and 4C, as described above, top cap housing 22 is attachable to first end 100 of inner housing 18 by cavity 114 of inner housing 18 receiving top cap housing 22 by an interference fit between the exterior wall surface of sidewall 154 of top cap housing 22 and the interior wall surface of first region wall 113 as shown in FIGS. 4B and 4C. With connector 20 and top cap housing 22 properly positioned within inner housing 18, first end 130 of connector 20 is received within connector receiving portion 156 of top cap housing 22 as shown in FIGS. 4B and 4C.

With top cap housing 22 properly secured to inner housing 18 as described above, the top cap housing 22 seals vial access device 12, i.e., top cap housing 22 provides a substantially impermeable enclosure with respect to vial access device 12, provides a leak prevention and protection enclosure, protects the contents of vial access device 12, and/or maintains a sealed, sterilized environment within vial access device 12. Top cap housing 22 provides a sufficient seal at a range of temperatures, pressures, and humidity levels.

Referring to FIGS. 1, 4B, 4C, 7, and 19, pressure equalization system 24 includes pressure equalization housing 160 and expandable balloon 162 which includes an expansion chamber 164. Pressure equalization housing 160 also includes flange portion 166. Expandable balloon 162 includes a variable volume. Pressure equalization housing 160 comprises a relatively rigid material and expandable balloon 162 comprises a relatively flexible material. In one embodiment, expandable balloon 162 comprises a thin, transparent plastic film that is attached to pressure equalization housing 160 in a gastight manner. In one embodiment, expandable balloon 162 is designed as a bellow which is compressible and extendable and, thus, the volume of the expansion chamber 164 of expandable balloon 162 can thereby be increased and decreased. In one embodiment, pressure equalization housing 160 extends radially around inner housing 18 and expandable balloon 162 extends radially around inner housing 18. In one embodiment, expandable balloon 162 comprises a toroidal shape. In other embodiments, pressure equalization system 24 comprises other pressure equalization systems which are compatible with a closed system drug transfer device.

Pressure equalization housing 160 provides a barrier wall member that protects expandable balloon 162 from being torn during engagement of a cannula with a vial, during transfer of a substance from a vial chamber 96 to a barrel chamber, e.g., barrel assembly 28 (FIGS. 20-23), via the cannula, and during disengagement of the cannula from the vial. In one embodiment, by having expandable balloon 162 extending radially around the entirety of inner housing 18 of vial access device 12, the vial access device 12 is balanced such that a center of mass is positioned at about a longitudinal axis of vial access device 12. In one embodiment, expandable balloon 162 extends three-hundred sixty degrees (360°) radially around inner housing 18 of vial access device 12. In one embodiment, a portion of expandable balloon 162 is not covered by pressure equalization housing 160. In this manner, expandable balloon 162 is capable of expanding in an axial direction.

As discussed above, pressure equalization housing 160 is received within outer housing 16 such that first shoulder 44 of outer housing 16 provides an engagement surface with flange portion 166 of pressure equalization housing 160 as shown in FIGS. 4B and 4C. In one embodiment, pressure equalization housing 160 and outer housing 16 are a single integral component. In another embodiment, pressure equalization housing 160 and outer housing 16 are separate components and pressure equalization housing 160 is attachable to outer housing 16 such that significant relative movement between pressure equalization housing 160 and outer housing 16 is prevented.

In one embodiment, a pressure normalization channel extends from piercing tip 124 to expandable balloon 162. In this manner, the pressure normalization channel is arranged to provide gas communication between the expandable balloon 162 and the interior of a vial when vial access device 12 is connected to a vial. The pressure normalization channel may be embodied as any suitable pressure normalization channel arrangement. With vial access device 12 connected to a vial, a syringe, cannula assembly, or syringe adapter, e.g., syringe adapter 27 (FIGS. 20 and 21), may be used to inject fluid into the vial or to withdraw fluid therefrom. Pressure equalization system 24 may be embodied as any other suitable pressure equalization system arrangement.

The function and advantages of pressure equalization system 24, according to the present disclosure, will be described in greater detail. When preparing and administering drugs, care has to be taken to minimize, or preferably eliminate, the risk of exposing people, such as medical and pharmacological personnel, to toxic substances. Some drugs must be dissolved or diluted before they are administered, which involves transferring a solvent from one container to a sealed vial containing the drug in powder or liquid form, by means of a needle, for example. Drugs may be inadvertently released into the atmosphere in gas form or by way of aerosolization during the withdrawal of the needle from the vial and while the needle is inside the vial if any pressure differential between the interior of the vial and surrounding atmosphere exists. Vial access device 12 of the present disclosure eliminates this problem by using pressure equalization system 24 of vial access device 12 that may be attached to a vial during the preparation of drugs. The pressure equalization system 24 includes an expandable balloon 162 which is in communication with the interior of a vial which ensures that neither an increased pressure nor a vacuum can occur inside the vial, e.g., first vial 80 (FIGS. 16-19) or second vial 90 (FIGS. 13-15), when gas or liquid is injected into or withdrawn from the vial. In one embodiment, the expandable balloon 162 may be filled with cleaned or sterilized air prior to its use to ensure that the contents of the vial do not become contaminated with air-borne particles such as dust, pollen, mold, bacteria, or other undesirable substances.

Referring to FIGS. 16-19, 20, and 21, the vial access device 12 may be secured to a cannula of syringe adapter 27 which in turn can be connected to a fluid container, such as barrel assembly 28, and the vial access device 12 can also be assembled via its vial connection elements 52 with a second fluid container, such as a first vial 80. As vial access device 12 is assembled with the first vial 80, the piercing tip 124 of the spike member 122 is pierced through a septum 84 of the first vial 80. First vial 80 may be a standard drug vial of any type having an open head portion covered by a pierceable septum of an elastomeric material. As discussed above, the plurality of vial grip members 54 fixedly connect vial access device 12 to the first vial 80 as the hook protrusions 56 of vial grip members 54 engage the corresponding flange 87 on first vial 80 as shown in FIG. 18. After assembly, a user is able to insert fluid into the first vial 80, or optionally, to retract fluid from the first vial 80.

Figure 19:
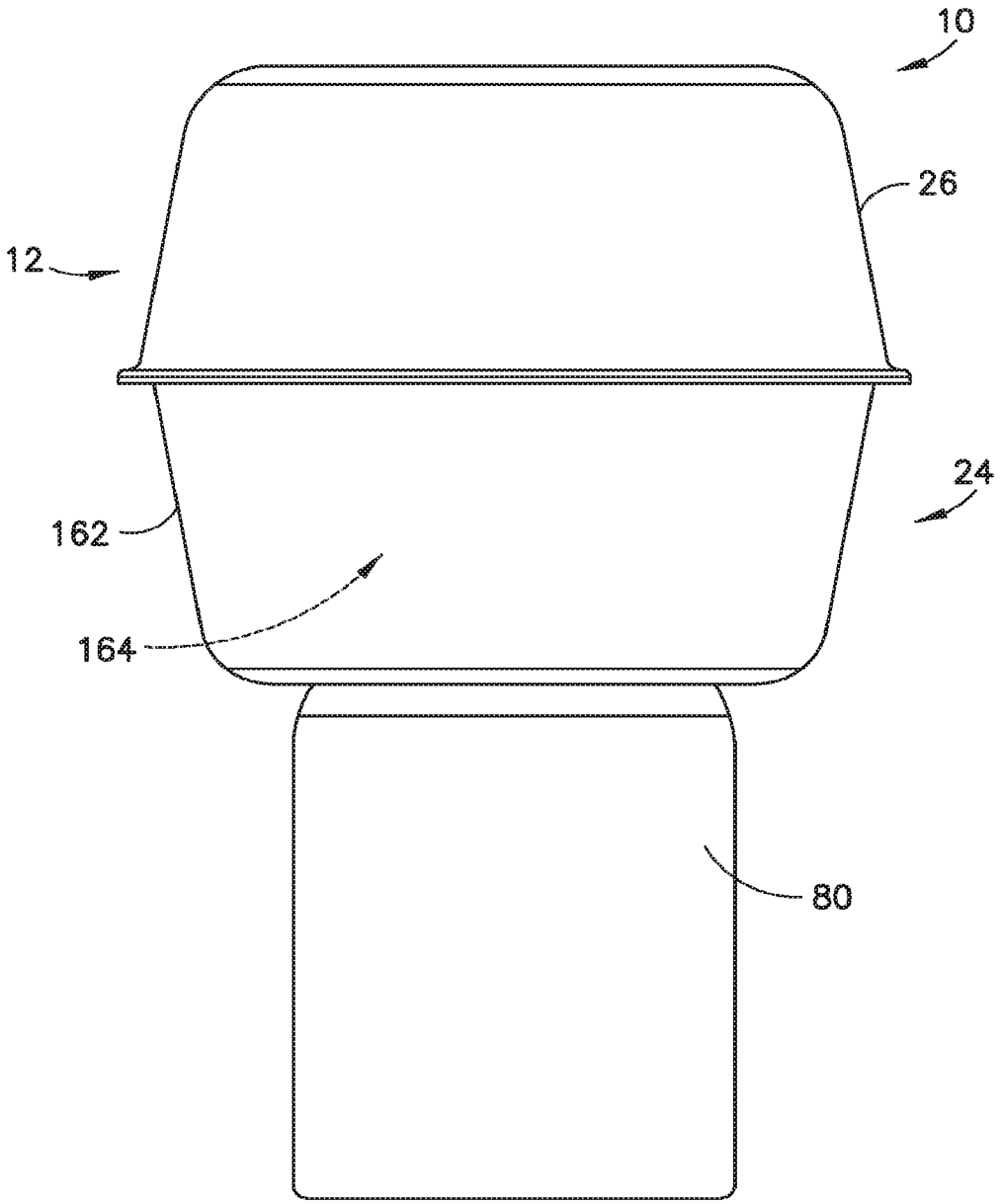
FIG. 19 is a side elevation view of a system having a pressure equalization system connected to a vial in accordance with an embodiment of the present invention.
Figure 20:
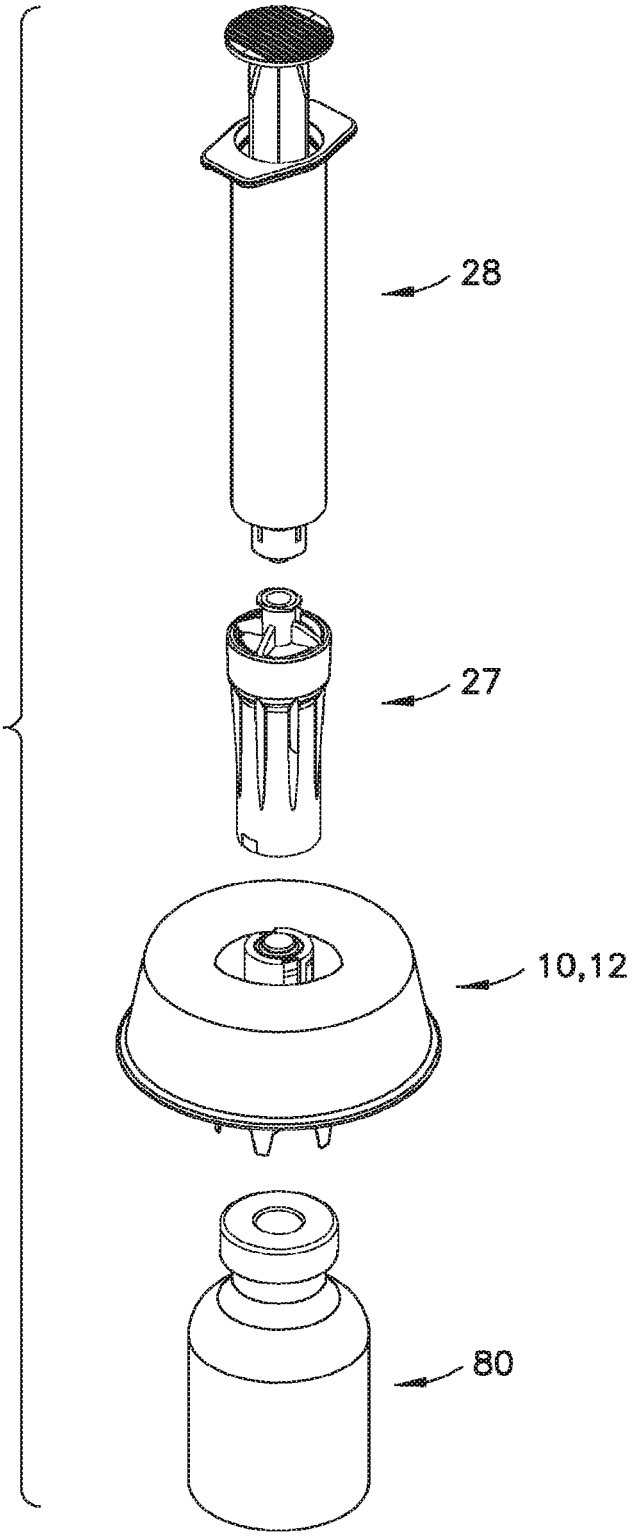
FIG. 20 is an exploded, perspective view of a system in accordance with an embodiment of the present invention.
Figure 21:
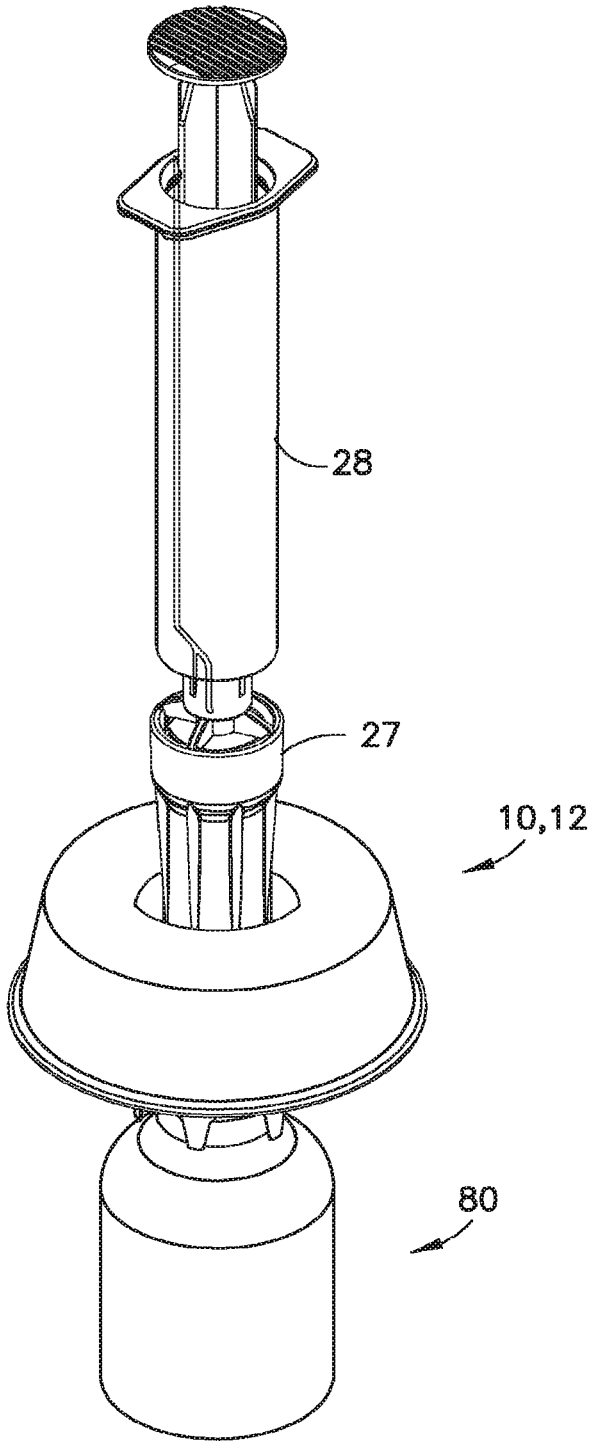
FIG. 21 is an assembled, perspective view of a system in accordance with an embodiment of the present invention.
Figure 22:
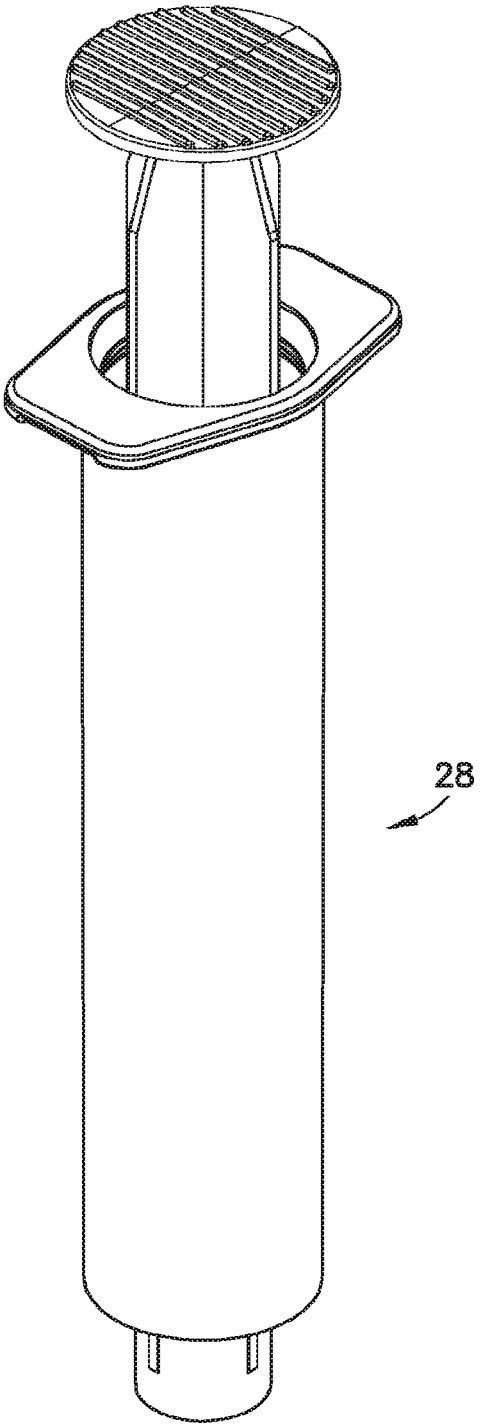
FIG. 22 is a perspective view of a barrel assembly in accordance with an embodiment of the present invention.
Figure 23:
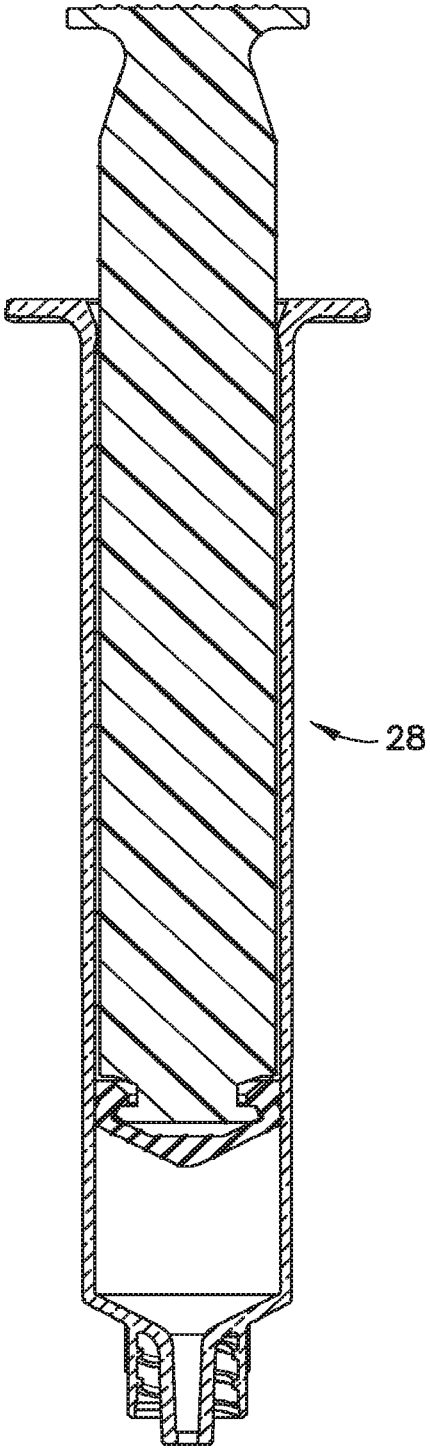
FIG. 23 is a cross-sectional view of the barrel assembly of FIG. 22 in accordance with an embodiment of the present invention.

As a fluid is inserted into the first vial 80, using the cannula of syringe adapter 27 and barrel assembly 28 (FIGS. 20-23), an overpressure is created inside the first vial 80. The pressure equalization system 24 of vial access device 12 permits pressure equalization between the first vial 80 and the expandable balloon 162. The pressure normalization channel of the pressure equalization system 24 normalizes the pressure inside the first vial 80 by relieving the pressure inside the first vial 80 to the expansion chamber 164 of the expandable balloon 162 as shown in FIG. 19.

Referring to FIGS. 12A-12H, 15, and 18, adapter 14 is generally annular and includes first or proximal end 170; opposing second or distal end 172; guide channels 174; vial connection element 176 comprising adapter vial grip members 178, hook protrusions 180, and angled walls 182; and locking members or outer housing engagement portions 184. Adapter 14 is sized and shaped for movement within the elongate opening 50 of vial access housing 26 and the adapter 14 is transitionable between a first position (FIGS. 13-15) in which the adapter 14 is adjacent the opening distal end 66 of the vial access housing 26 and the adapter 14 is attachable to a second vial 90 defining a second vial size 91, the second vial size 91 different than the first vial size 81 of first vial 80, and a second position (FIGS. 16-18) in which the adapter 14 is adjacent the opening proximal end 64 of the vial access housing 26 and the vial connection element 52 of the vial access device 12 is attachable to the first vial 80.

Figure 12A:
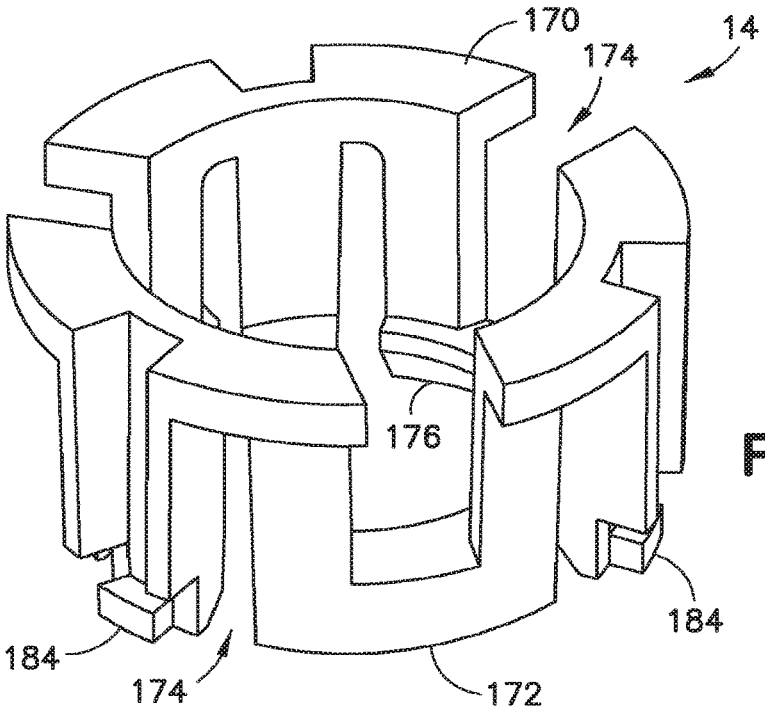
FIG. 12A is a perspective view of an adapter in accordance with an embodiment of the present invention.
Figure 12B:
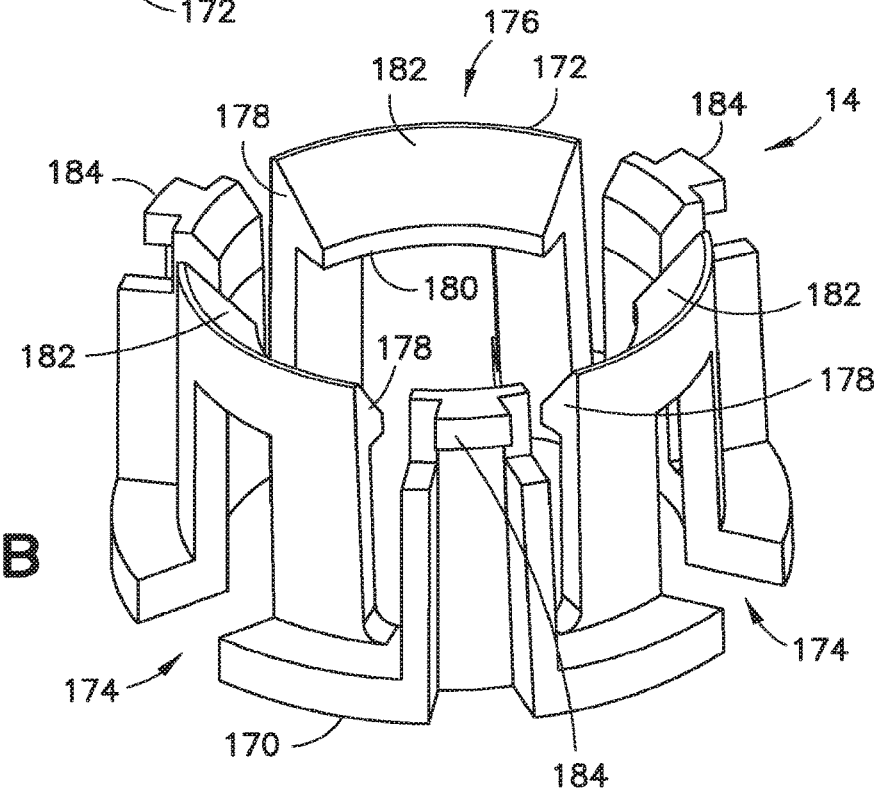
FIG. 12B is another perspective view of an adapter in accordance with an embodiment of the present invention.
Figure 12C:
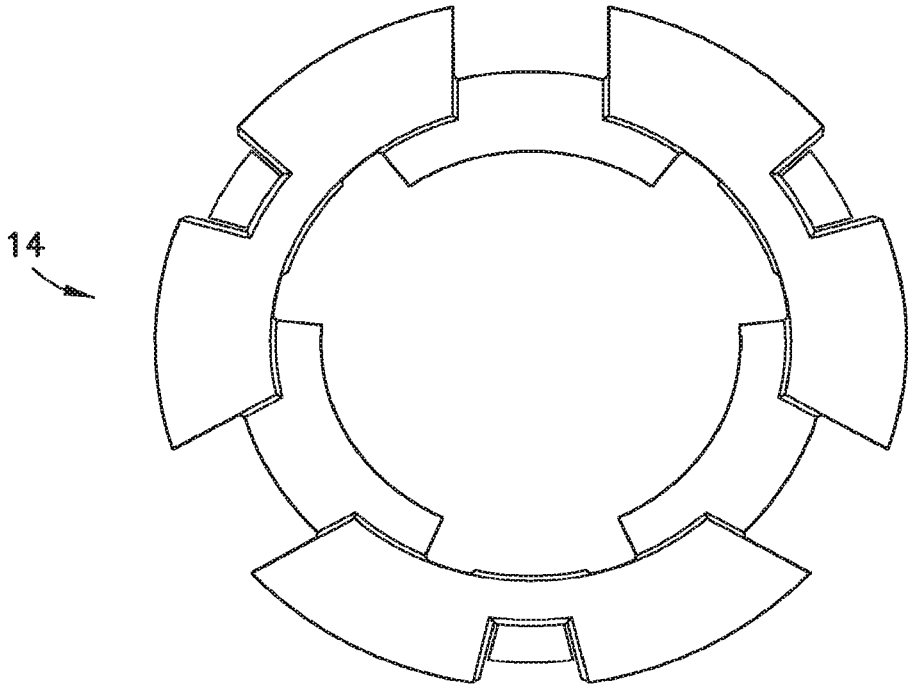
FIG. 12C is a top view of an adapter in accordance with an embodiment of the present invention.
Figure 12D:
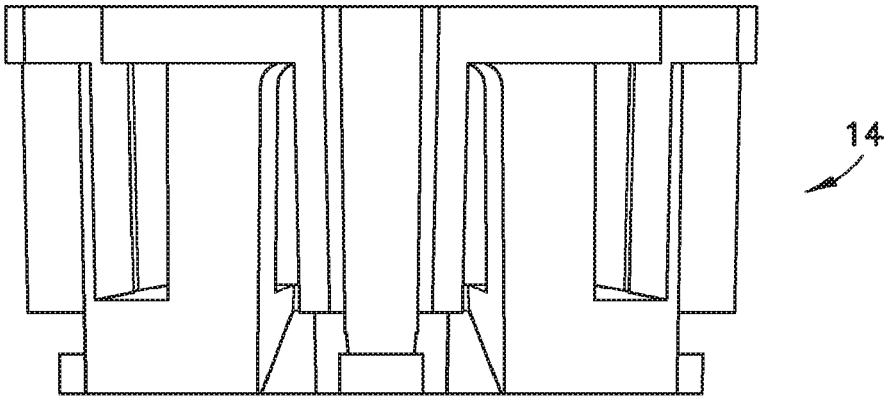
FIG. 12D is a side elevation view of an adapter in accordance with an embodiment of the present invention.
Figure 12E:
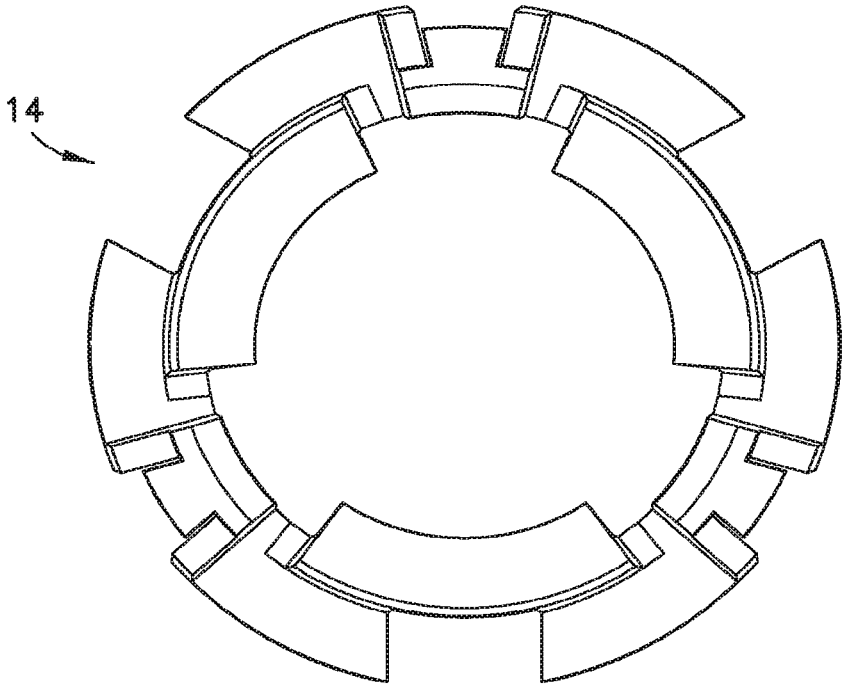
FIG. 12E is a bottom view of an adapter in accordance with an embodiment of the present invention.
Figure 12F:
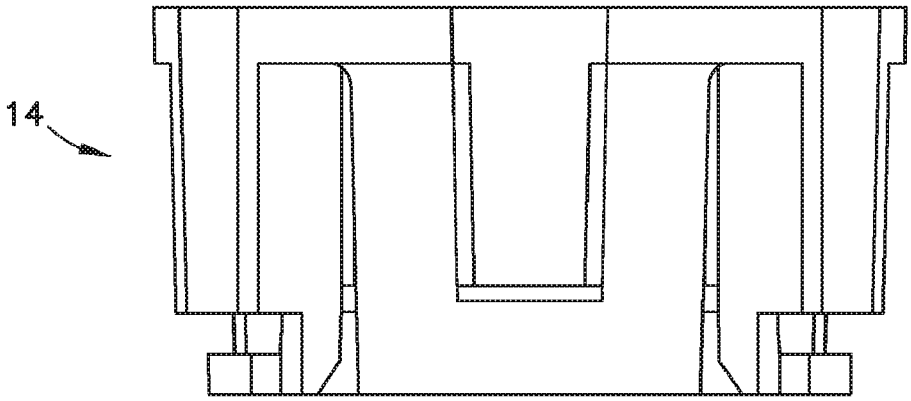
FIG. 12F is another side elevation view of an adapter in accordance with an embodiment of the present invention.
Figure 12G:
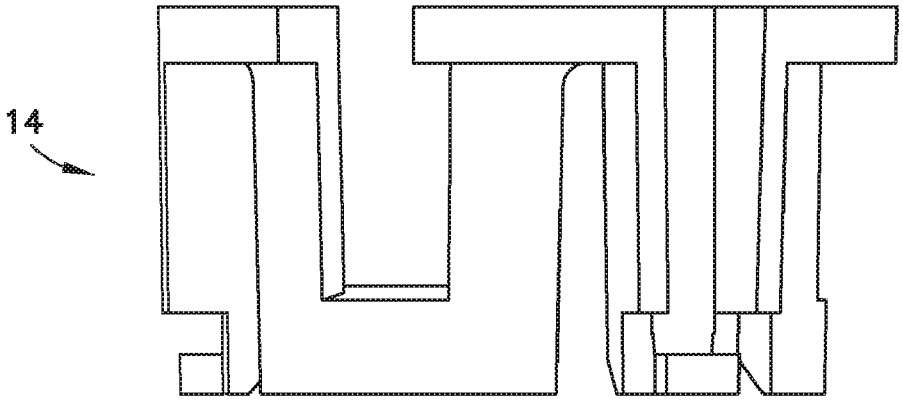
FIG. 12G is another side elevation view of an adapter in accordance with an embodiment of the present invention.
Figure 12H:
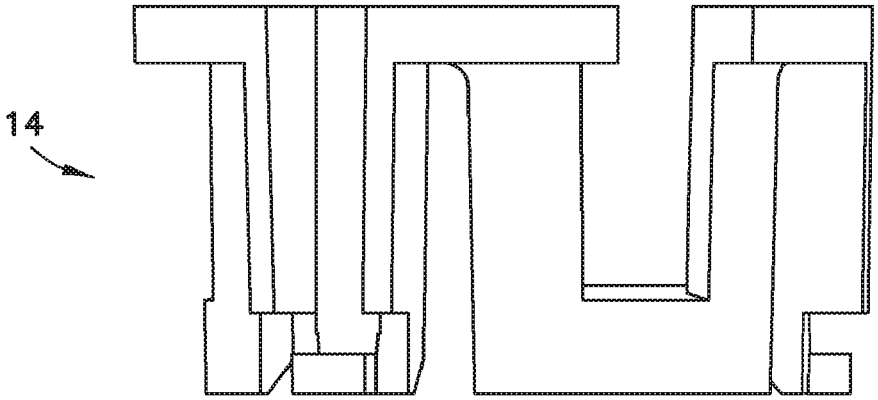
FIG. 12H is another side elevation view of an adapter in accordance with an embodiment of the present invention.

Referring to FIGS. 12B and 15, a vial connection element 176 is disposed at second end 172 of adapter 14. In one embodiment, vial connection element 176 includes a plurality of adapter vial grip members 178 having hook protrusions 180 and angled walls 182. In one embodiment, adapter vial grip members 178 are elastically deformable. Adapter vial grip members 178 are attachable to a second vial 90 to secure vial access device 12 to the second vial 90 via adapter 14. In this manner, vial access device 12 and adapter 14 provide a system 10 that is capable of accommodating a plurality of vials having different sizes, e.g., first vial 80 having first vial size 81 and second vial 90 having second vial size 91. Each adapter vial grip member 178 includes a hook protrusion 180 arranged to engage a corresponding flange 97 on a container such as second vial 90 as shown in FIG. 15. Vial connection element 176 of adapter 14 may be dimensioned to be attached to containers of any size and volume. In other embodiments, vial connection element 176 of adapter 14 may include other connection mechanisms for securing adapter 14 and vial access device 12 to second vial 90 such as a threaded portion, a snap fit mechanism, locking tabs, or other similar mechanism. Each adapter vial grip member 178 includes an angled wall 182 arranged to provide a lead-in surface to center and align vial access device 12 on a vial.

As discussed above, vial access device 12 and adapter 14 provide a system 10 that is capable of accommodating a plurality of vials having different sizes, e.g., first vial 80 having first vial size 81 and second vial 90 having second vial size 91. In one embodiment, it is envisioned that vial access device 12 and adapter 14 are compatible with a first vial 80 comprising a 20 mm vial and a second vial 90 comprising a 13 mm vial. In another embodiment, it is envisioned that vial access device 12 and adapter 14 are compatible with a first vial 80 comprising a 28 mm vial and a second vial 90 comprising a 20 mm vial. In another embodiment, it is envisioned that vial access device 12 and adapter 14 are compatible with a first vial 80 comprising a 32 mm vial and a second vial 90 comprising a 28 mm vial. In other embodiments, it is envisioned that vial access device 12 and adapter 14 are compatible with a first vial 80 comprising other vial sizes and a second vial 90 comprising other vial sizes, wherein the second vial size is less than the first vial size.

Figure 4D:
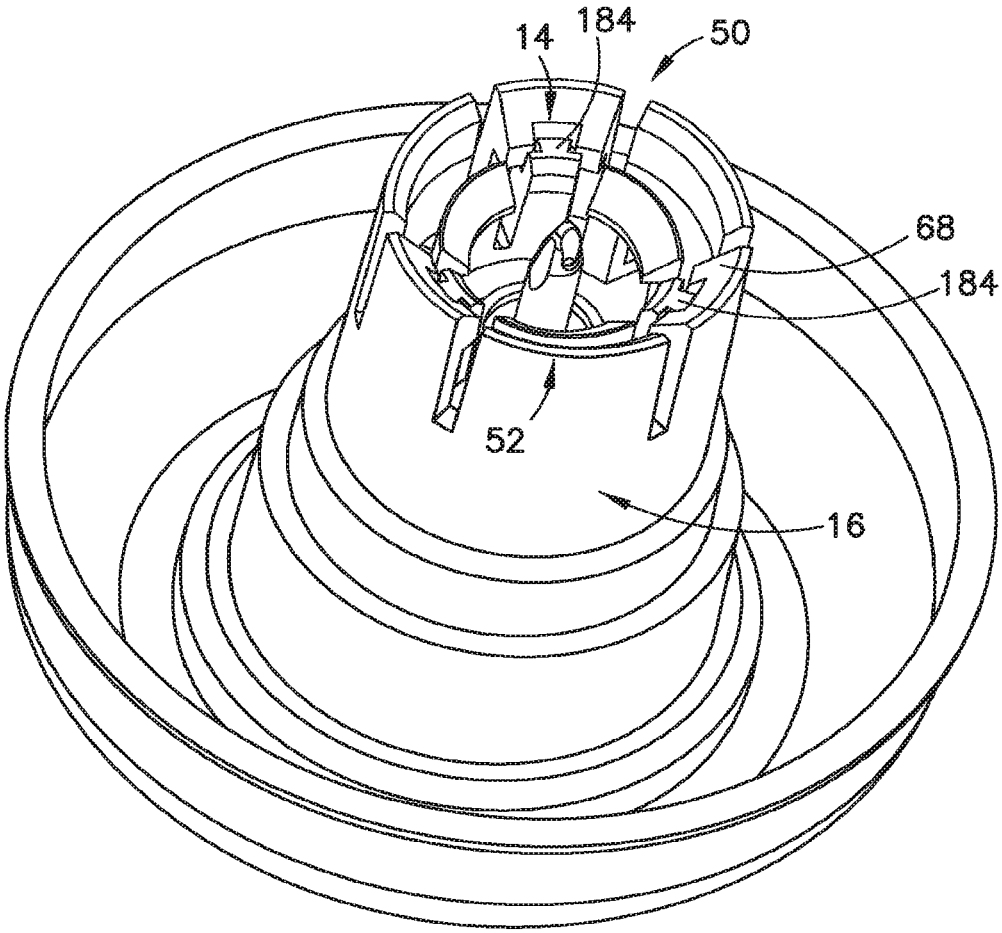
FIG. 4D is a bottom, perspective view of a system in accordance with an embodiment of the present invention.

Referring to FIGS. 4D and 15, locking member or outer housing engagement portions 184 of adapter 14 engage adapter engagement portions 68 which act as a physical barrier to prevent adapter 14 from being removed from within elongate opening 50. Adapter 14 is sized for movement within elongate opening 50 of vial access housing 26 and engagement of adapter engagement portions 68 with locking members 184 of adapter 14 prevents adapter 14 from being removed from elongate opening 50. As shown in FIG. 4D, the adapter engagement portions 68 may also define a correspondingly shaped channel that receives a portion of the locking members 184 to provide a guided, controlled movement of adapter 14 between the first position (FIGS. 13-15) and the second position (FIGS. 16-18) and establish a secure attachment between the adapter 14 and the outer housing 16 as shown in FIGS. 15 and 18.

Referring to FIGS. 15 and 18, the use of vial access device 12 and adapter 14 to provide a system 10 that is capable of accommodating a plurality of vials having different sizes, e.g., first vial 80 having first vial size 81 and second vial 90 having second vial size 91, will now be described.

Referring to FIG. 15, with the adapter 14 in the first position, the adapter 14 is adjacent the opening distal end 66 of the vial access housing 26 and the adapter 14 is attachable to the second vial 90 defining the second vial size 91 as described above. With the vial access device 12 attachable to the second vial 90 via the adapter 14, the spike member 122 is in fluid communication with vial chamber 96 of the second vial 90 as shown in FIG. 15. With the vial access device 12 attached to the second vial 90 via the adapter 14, system 10 provides substantially leak-proof sealing and pressure equalization during engagement of a cannula of syringe adapter 27 with second vial 90 during transfer of a substance from vial chamber 96 to a barrel chamber of barrel assembly 28 via the cannula, and during disengagement of the cannula from the second vial 90. The leak-proof sealing of the system 10 substantially prevents leakage of both air and liquid during use of the system 10. System 10 is compatible with a needle and syringe assembly for accessing a medication contained within a vial for administering the medication to a patient. System 10 is also compatible to be used with a drug reconstitution system. Furthermore, as a fluid is inserted into the second vial 90, using the cannula of syringe adapter 27 and barrel assembly 28 (FIGS. 20-23), an overpressure is created inside the second vial 90. The pressure equalization system 24 of vial access device 12 permits pressure equalization between the second vial 90 and the expandable balloon 162. The pressure normalization channel of the pressure equalization system 24 normalizes the pressure inside the second vial 90 by relieving the pressure inside the second vial 90 to the expansion chamber 164 of the expandable balloon 162 as shown in FIG. 19.

Figure 16:
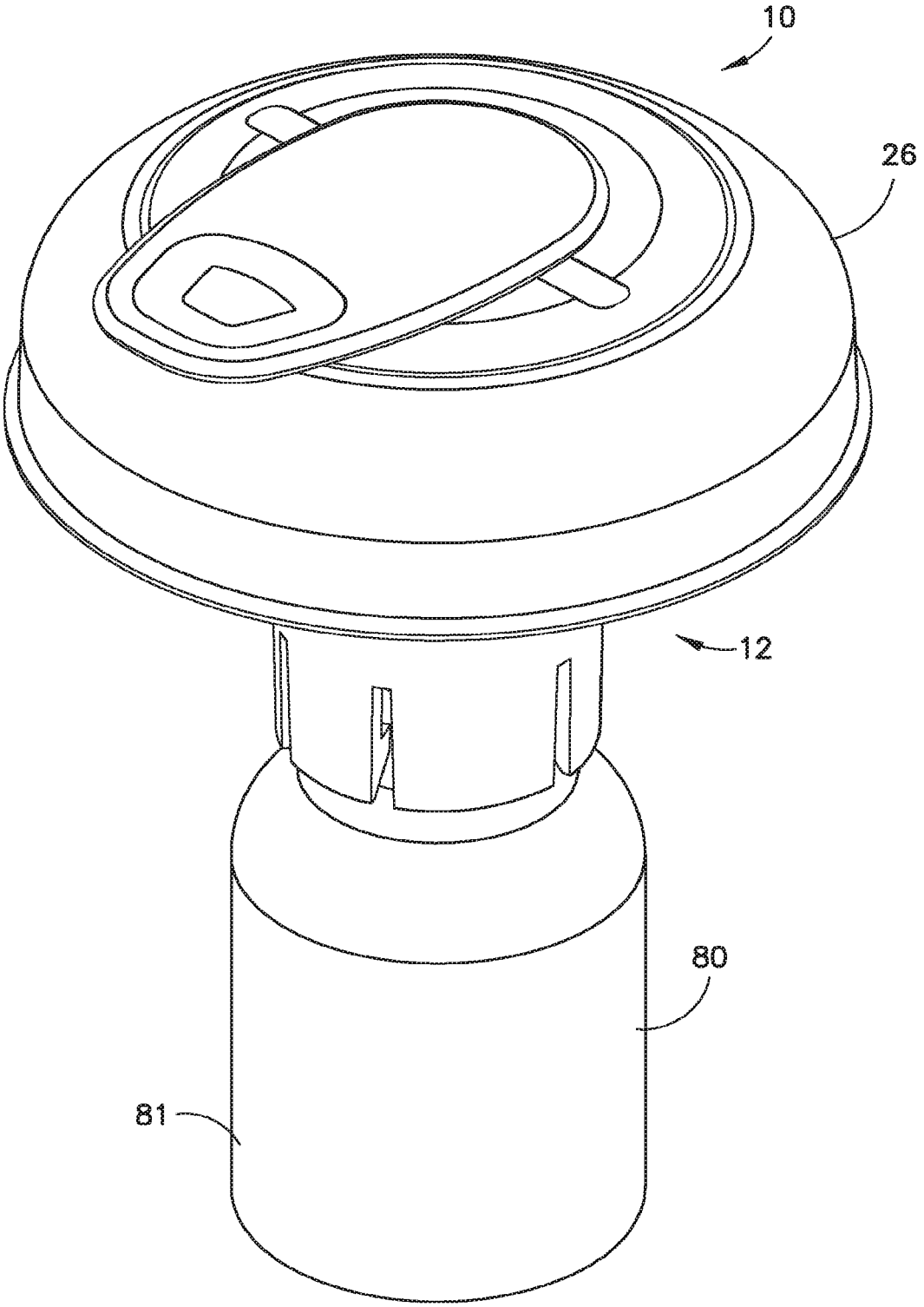
FIG. 16 is a perspective view of a system of the present disclosure connected to a second vial in accordance with an embodiment of the present invention.
Figure 17:
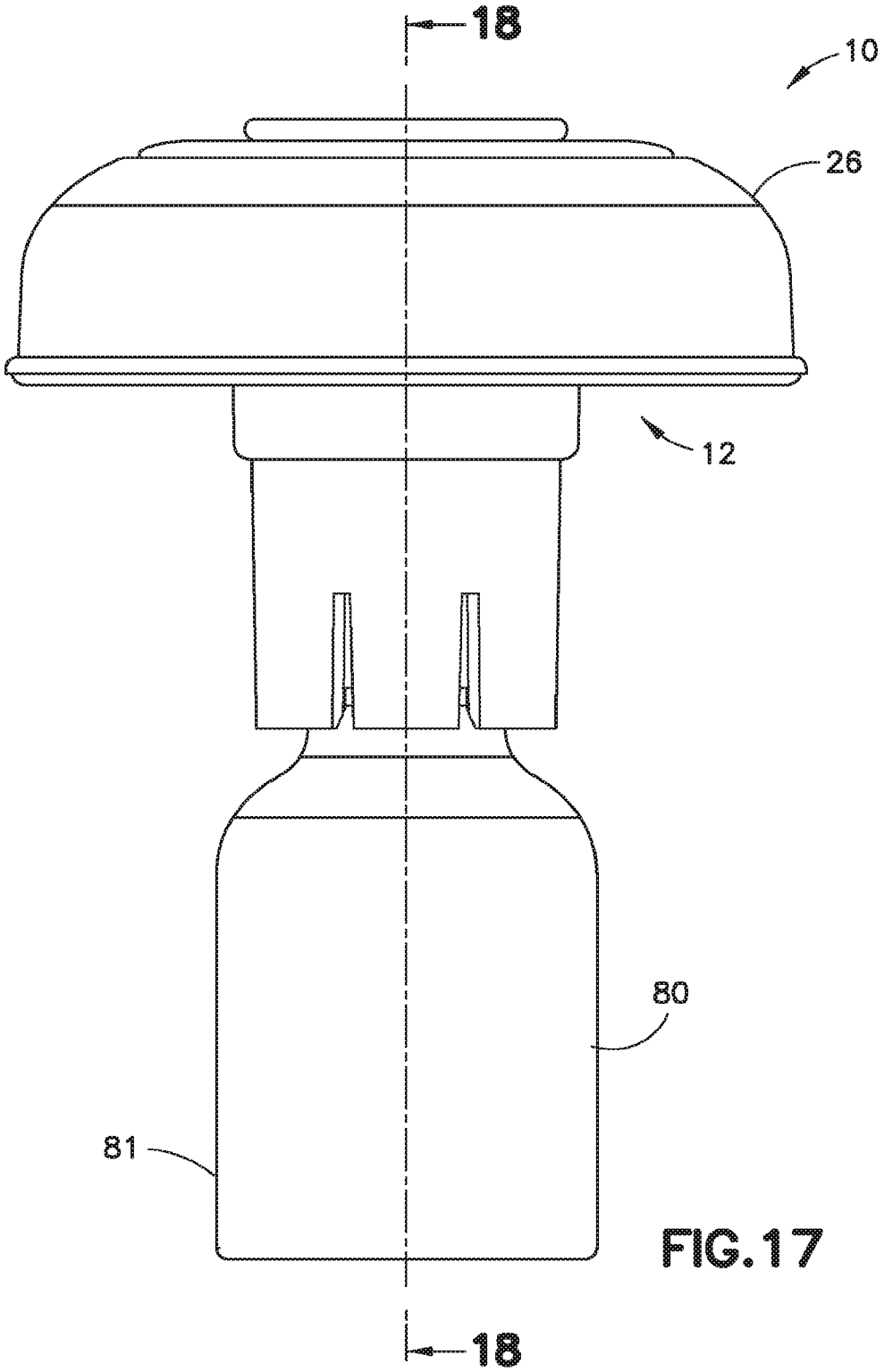
FIG. 17 is a side elevation view of a system of the present disclosure connected to a second vial in accordance with an embodiment of the present invention.

As discussed above, adapter 14 is sized and shaped for movement within the elongate opening 50 of vial access housing 26 and the adapter 14 is transitionable between the first position (FIGS. 13-15) and the second position (FIGS. 16-18).

Referring to FIG. 18, with the adapter 14 in the second position, the adapter 14 is adjacent the opening proximal end 64 of the vial access housing 26 and the vial connection element 52 of the vial access device 12 is attachable to the first vial 80 as described above. With the adapter in the second position, the adapter is disposed above the vial connection element 52 of the vial access device 12. In this manner, the adapter 14 is out of the way of the vial connection element 52 and the vial connection element 52 is attachable to the first vial 80. The adapter 14 may be transferred from the first position to the second position when the vial access device 12 engages the first vial 80. With the vial access device 12 attachable to the first vial 80, the spike member 122 is in fluid communication with vial chamber 86 of the first vial 80 as shown in FIG. 18. With the vial access device 12 attached to the first vial 80, system 10 provides substantially leak-proof sealing and pressure equalization during engagement of a cannula of syringe adapter 27 with first vial 80, during transfer of a substance from vial chamber 86 to a barrel chamber of barrel assembly 28 via the cannula, and during disengagement of the cannula from the first vial 80. The leak-proof sealing of the system 10 substantially prevents leakage of both air and liquid during use of the system 10. System 10 is compatible with a needle and syringe assembly for accessing a medication contained within a vial for administering the medication to a patient. System 10 is also compatible to be used with a drug reconstitution system. Furthermore, as a fluid is inserted into the first vial 80, using the cannula of syringe adapter 27 and barrel assembly 28 (FIGS. 20-23), an overpressure is created inside the first vial 80. The pressure equalization system 24 of vial access device 12 permits pressure equalization between the first vial 80 and the expandable balloon 162. The pressure normalization channel of the pressure equalization system 24 normalizes the pressure inside the first vial 80 by relieving the pressure inside the first vial 80 to the expansion chamber 164 of the expandable balloon 162 as shown in FIG. 19.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A method of securing a vial of one of a first vial size or a second vial size to a vial access device, the method comprising:

selecting a system comprising:

the vial access device including a vial access housing having a wall defining an elongate opening between an opening proximal end and an opening distal end, the vial access housing including a spike and a vial connection element attachable to the vial of the first vial size to secure the vial access device to the vial of the first vial size; and an adapter movable within the elongate opening of the vial access housing, the adapter transitionable between a first position where the adapter is adjacent the opening distal end of the vial access housing and the adapter is attachable to the vial of the second vial size, the second vial size different than the first vial size, and a second position where the adapter is adjacent the opening proximal end of the vial access housing and the vial connection element of the vial access device is attachable to the vial of the first vial size;

engaging the vial of one of the first vial size or the second vial size with the vial access device where the adapter is in the first position;

when the vial is of the first vial size, transitioning the adapter from the first position to the second position; and securing the vial access device to the vial of the first vial size with the adapter in the second position.

2. The method of claim 1, the method further comprising, when the vial is of the second vial size, securing the adapter to the vial of the second vial size with the adapter in the first position.

3. The method of claim 1, wherein transitioning the adapter from the first position to the second position comprises sliding the adapter through at least a portion of the elongate opening towards the opening proximal end of the vial access housing.

4. The method of claim 1, wherein the adapter is separate from the vial access housing.

5. The method of claim 1, wherein the second vial size is smaller than the first vial size.

6. The method of claim 1, wherein the adapter comprises a locking member that engages a portion of the vial access housing to prevent the adapter from being removed from within the elongate opening of the vial access housing.

7. The method of claim 1, wherein, upon securing the vial, the spike is in fluid communication with a chamber of the vial.

8. The method of claim 1, wherein the vial access device includes a pressure equalization system.

9. The method of claim 1, wherein the first vial size is one of 20 mm, 28 mm, or 32 mm, and the second vial size is one of 13 mm, 20 mm, or 28 mm.

10. The method of claim 1, wherein the vial connection element of the vial access device includes a plurality of vial grip members.

11. The method of claim 10, wherein the plurality of vial grip members are elastically deformable.

12. A method of securing a vial of one of a first vial size or a second vial size to a vial access device, the method comprising:

selecting a system comprising:

the vial access device including a vial access housing having a wall defining an elongate opening between an opening proximal end and an opening distal end, the vial access housing including a spike and a vial connection element attachable to the vial of the first vial size to secure the vial access device to the vial of the first vial size; and an adapter movable within the elongate opening of the vial access housing, the adapter transitionable between a first position where the adapter is adjacent the opening distal end of the vial access housing and the adapter is attachable to the vial of the second vial size, the second vial size different than the first vial size, and a second position where the adapter is adjacent the opening proximal end of the vial access housing and the vial connection element of the vial access device is attachable to the vial of the first vial size;

engaging the vial of the first vial size with the vial access device where the adapter is in the first position;

transitioning the adapter from the first position to the second position; and securing the vial access device to the vial of the first vial size with the adapter in the second position.

13. The method of claim 12, wherein transitioning the adapter from the first position to the second position comprises sliding the adapter through at least a portion of the elongate opening towards the opening proximal end of the vial access housing.

14. The method of claim 12, wherein the adapter is separate from the vial access housing.

15. A method of securing a vial of one of a first vial size or a second vial size to a vial access device, the method comprising:

selecting a system comprising:

the vial access device including a vial access housing having a wall defining an elongate opening between an opening proximal end and an opening distal end, the vial access housing including a spike and a vial connection element attachable to the vial of the first vial size to secure the vial access device to the vial of the first vial size; and an adapter movable within the elongate opening of the vial access housing, the adapter transitionable between a first position where the adapter is adjacent the opening distal end of the vial access housing and the adapter is attachable to the vial of the second vial size, the second vial size different than the first vial size, and a second position where the adapter is adjacent the opening proximal end of the vial access housing and the vial connection element of the vial access device is attachable to the vial of the first vial size;

engaging the vial of the second vial size with the vial access device where the adapter is in the first position; and securing the vial access device to the vial of the second vial size with the adapter in the first position.

16. The method of claim 14, wherein the adapter is separate from the vial access housing.

* * * * *